US010012366B2

(12) United States Patent
Belmonte et al.

(10) Patent No.: US 10,012,366 B2
(45) Date of Patent: Jul. 3, 2018

(54) POT LIGHT ASSEMBLY

(71) Applicants: John-Paul Belmonte, Woodbridge (CA); Gino Cundari, Bradford (CA)

(72) Inventors: John-Paul Belmonte, Woodbridge (CA); Gino Cundari, Bradford (CA)

( * ) Notice: Subject to any disclaimer, the term of this patent is extended or adjusted under 35 U.S.C. 154(b) by 0 days.

(21) Appl. No.: 15/000,095

(22) Filed: Jan. 19, 2016

(65) Prior Publication Data

US 2016/0209007 A1 Jul. 21, 2016

Related U.S. Application Data

(60) Provisional application No. 62/104,979, filed on Jan. 19, 2015.

(51) Int. Cl.

| | |
|---|---|
| ***F21V 21/04*** | (2006.01) |
| ***E04B 9/00*** | (2006.01) |
| *F21S 8/02* | (2006.01) |

(52) U.S. Cl.

CPC ..... *F21V 21/047* (2013.01); *E04B 9/006* (2013.01); *F21V 21/048* (2013.01); *F21S 8/026* (2013.01)

(58) Field of Classification Search

CPC ..... E04B 9/006; Y10S 248/906; E04C 2003/026; F21V 21/047; F21V 21/048; F21S 8/026

USPC ..... 248/200.1, 343, 323

See application file for complete search history.

(56) References Cited

U.S. PATENT DOCUMENTS 1,982,957 A * 12/1934 Knell ..... H02G 3/126 180/68.5
5,045,985 A * 9/1991 Russo ..... F21V 21/04 248/214
5,085,393 A 2/1992 Ryan
5,690,423 A * 11/1997 Hentz ..... F21S 8/02 248/302
5,938,157 A * 8/1999 Reiker ..... E04B 9/006 156/71
5,954,304 A * 9/1999 Jorgensen ..... H02G 3/125 248/200.1
5,957,574 A * 9/1999 Hentz ..... F21S 8/02 248/302
6,047,517 A 4/2000 Vrame
(Continued)

FOREIGN PATENT DOCUMENTS

JP 2003175122 A * 6/2003

OTHER PUBLICATIONS

CMHC_Chapter_9_Floor_Framing_pp. 106_285_286.
CMHC_Chapter_11_Ceiling and Roof Framing_pp. 132_303_304.

*Primary Examiner* — Brent W Herring
(74) *Attorney, Agent, or Firm* — ABM Intellectual Property Inc.; Adrienne Bieber McNeil

(57) ABSTRACT

A pot light assembly includes a rail and a pot light housing for housing a pot light. The rail has end portions for resting on upwardly facing surfaces of a pair of ceiling joists and a central portion between the end portions. The central portion is secured to a side wall at a top portion of the housing for supporting the housing between the ceiling joists. The pot light assembly further includes a pair of fastening brackets for securing the rail to the ceiling joists. Each bracket has a fastening plate positioned below the rail. The fastening plates have respective fastening holes through which a fastener can be secured to respective ceiling joists to fasten the fastening plates to the ceiling joists.

11 Claims, 16 Drawing Sheets

(56) References Cited

U.S. PATENT DOCUMENTS 6,176,599 B1 * 1/2001 Farzen ..... F21S 8/026 362/145
6,286,265 B1 9/2001 Rinderer
6,341,466 B1 1/2002 Kehoe et al.
6,345,800 B1 * 2/2002 Herst ..... E04B 9/006 248/342
6,461,016 B1 * 10/2002 Jamison ..... F21S 8/02 362/147
6,838,618 B2 * 1/2005 Newbold ..... F21S 8/02 174/17 VA
6,948,831 B1 9/2005 Naqvi
6,967,284 B1 * 11/2005 Gretz ..... H02G 3/125 174/50
6,993,882 B2 * 2/2006 Crawford ..... E04B 7/022 52/696
7,175,309 B2 * 2/2007 Craw ..... F21V 29/02 362/149
7,216,838 B1 5/2007 Gretz
7,455,432 B2 * 11/2008 Craw ..... F21V 29/02 362/149
7,654,495 B2 2/2010 Adrian et al.
7,673,427 B2 * 3/2010 Morey ..... E04D 13/031 24/458
7,784,754 B2 8/2010 Nevers et al.
7,857,275 B2 * 12/2010 de la Borbolla ..... H02G 3/125 174/58
7,874,539 B2 1/2011 Wright et al.
7,952,022 B2 * 5/2011 Rippel ..... H02G 3/125 174/50
8,038,113 B2 * 10/2011 Fryzek ..... F21S 8/026 248/343
8,177,176 B2 5/2012 Nguyen et al.
8,434,916 B2 * 5/2013 Craw ..... F21V 29/02 362/149
8,622,361 B2 1/2014 Wronski
8,800,943 B2 * 8/2014 Long ..... F04D 25/08 248/200.1
8,889,984 B2 * 11/2014 Korcz ..... F16M 13/027 174/40 R
8,961,126 B1 * 2/2015 Tom ..... F21V 29/02 362/368
9,060,607 B1 * 6/2015 Canales ..... A47F 5/0006
9,285,074 B2 * 3/2016 Korcz ..... F16M 13/027
9,414,142 B1 * 8/2016 Zauhar ..... H04R 1/025
9,441,369 B2 * 9/2016 Shaw ..... E04B 9/006
9,506,645 B1 * 11/2016 Tom ..... F24F 13/078
9,528,714 B2 * 12/2016 Tom ..... F04D 19/00
2007/0012847 A1 1/2007 Tai
2007/0075206 A1 * 4/2007 Wright ..... F04D 25/088 248/343
2007/0266674 A1 * 11/2007 Morey ..... E04D 13/031 52/783.11
2010/0224404 A1 * 9/2010 Rippel ..... H02G 3/125 174/520

* cited by examiner

POT LIGHT ASSEMBLY

CROSS-REFERENCE TO RELATED APPLICATIONS

This application claims the benefit of U.S. Provisional Application No. 62/104,979, entitled "POT LIGHT ASSEMBLY", filed Jan. 19, 2015. The entire contents of U.S. Provisional Application No. 62/104,979 are hereby incorporated by reference.

FIELD

The disclosure relates to pot lights, otherwise known as recessed lights. More specifically, the disclosure relates to insulation contact (IC) pot light assemblies that can be installed between and supported by a pair of ceiling joists.

BACKGROUND

U.S. Pat. No. 7,874,539 (Wright et al.) purports to disclose a bar hanger assembly for supporting a recessed electrical device in a ceiling support. The bar hanger includes first and second telescoping support arms that are slidably connected together for adjusting the length of the bar hanger. The support arms have an elongated body with first and second ends and a mounting plate coupled to the first end. The mounting plate is oriented substantially perpendicularly to the plane of the body. An attachment member is coupled to a bottom edge of the mounting plate for attaching to the bottom edge of a ceiling joist. The attachment member includes a detent extending from one side thereof. The attachment member can be bent from a first position perpendicular to the mounting plate to a second position parallel to the mounting plate for attaching to a T-bar support.

U.S. Pat. No. 8,622,361 (Wronski) purports to disclose a hanger bar assembly for a recessed luminaire. The hanger bar assembly includes a first hanger bar member having a first attachment structure disposed on an end thereof, and a second hanger bar member having a second attachment structure disposed on an end thereof. The second hanger bar member is adjacent to the first hanger bar member. The first and the second attachment structures each include a first wall having a first fastener aperture and a second wall having a second fastener aperture. The first and second fastener apertures are formed about a common central longitudinal axis.

SUMMARY

The following summary is intended to introduce the reader to various aspects of the applicant's teaching, but not to define any invention.

According to one aspect, a method for installing a pot light assembly includes securing a first rail portion and a second rail portion to a side wall of a housing of the pot light assembly. The side wall extends between a top end of the housing and a bottom end of the housing. The bottom end of the housing has an opening through which a pot light is receivable. The method further includes positioning the housing between first and second ceiling joists. The method further includes resting the first rail portion and the second rail portion on upwardly facing surfaces of the first and second ceiling joists, respectively, so that the first rail portion and the second rail portion support the housing between the first and second ceiling joists and the opening faces downwardly. The method further includes fastening first and second fastening plates of the pot light assembly to side surfaces of the first and second ceiling joists, respectively, to secure the first rail portion and the second rail portion to the first and second ceiling joists, respectively.

The step of securing the first rail portion and the second rail portion to the side wall of the housing may include securing the first rail portion and the second rail portion to a top portion of the housing.

The step of securing the first rail portion and the second rail portion to the side wall of the housing may include securing the first rail portion and the second rail portion to a side wall portion of the side wall such that the first rail portion, second rail portion, and the side wall portion are generally parallel.

The step of securing the first rail portion and the second rail portion to the side wall of the housing may include securing the first rail portion and the second rail portion to a side wall portion of the side wall, and the step of positioning the housing between the first and second ceiling joists may include positioning the housing such that the side wall portion is generally vertically extending.

The step of fastening the first and second plates of the pot light assembly may include fastening the first and second fastening plates to inner side surfaces of the first and second ceiling joists, respectively, the inner side surfaces facing the housing.

The step of fastening the first and second plates of the pot light assembly may include fastening the first and second fastening plates to outer side surfaces of the first and second ceiling joists, respectively, the outer side surfaces facing away from the housing.

The first rail portion and the second rail portion may be separately formed, and the step of securing the first rail portion and the second rail portion to the side wall of the housing may include securing the first rail portion and the second rail portion together to form a first rail while securing the first rail portion and the second rail portion to the housing.

The first rail portion and the second rail portion may be separately formed, and the step of securing the first rail portion and the second rail portion to the side wall of the housing may include securing the first rail portion and the second rail portion together to form a first rail, and then securing the first rail to the housing.

The method may further include, prior to the step of securing the first rail portion and the second rail portion to the side wall of the housing, sliding the first rail portion relative to the second rail portion to set a length of the first rail.

The first rail portion and the second rail portion may be separately formed and provided secured together as a first rail.

The first rail portion and the second rail portion may be integral and together form a first rail.

The method may further include, prior to the step of securing the first rail portion and the second rail portion to the side wall of the housing, adjusting a position of the first rail portion and the second rail portion on the housing by moving the first rail along a vertical axis extending between the top and bottom ends of the housing.

The method may further include, prior to the step of positioning the housing between the first and second ceiling joists, securing a third rail portion and a fourth rail portion to the side wall of the housing opposite the first rail portion and the second rail portion. The step of resting the first rail portion and the second rail portion on upwardly facing surfaces of the first and second ceiling joists may include resting the third rail portion and the fourth rail portion on upwardly facing surfaces of the first and second ceiling joists, respectively, so that the third rail portion and the fourth rail portion support the housing between the first and second ceiling joists. The step of fastening the first and second fastening plates further may include fastening third and fourth fastening plates of the pot light assembly to side surfaces of the first and second ceiling joists, respectively, to secure the third rail portion and the fourth rail portion to the first and second ceiling joists.

According to another aspect, a ceiling section includes a first ceiling joist and a second ceiling joist adjacent and parallel to the first ceiling joist. The ceiling section further includes a pot light assembly secured to the first and second ceiling joists. The pot light assembly includes a pot light housing for housing a pot light. The pot light housing has a top portion defining a top end, an opposing bottom portion defining a bottom end and having an opening through which a pot light is receivable, and a side wall extending between the top end and the bottom end. The pot light assembly further includes a first rail portion and a second rail portion. The first rail portion and the second rail portion are secured to the side wall at the top portion of the housing. The first rail portion and the second rail portion rest on upwardly facing surfaces of the first and second ceiling joists, respectively, and support the housing between the first and second ceiling joists such that the opening of the housing faces downwardly. The pot light assembly further includes first and second fastening brackets securing the first rail portion and the second rail portion to the first and second ceiling joists, respectively. The first and second fastening brackets have first and second fastening plates, respectively. The first and second fastening plates are positioned below the first rail portion and the second rail portion, respectively, and have respective fastening holes through which a fastener fastens the first and second fastening plates to the first and second ceiling joists, respectively.

The first rail portion and the second rail portion may be secured to a side wall portion of the side wall, and the side wall portion may be generally vertically extending.

The pot light housing may further include a top wall at the top end.

The first rail portion and the second rail portion may be secured to a side wall portion of the side wall, and the first rail portion, second rail portion, and side wall portion may be generally parallel.

The first and second fastening plates may be positioned between the first and second ceiling joists.

The first and second fastening plates may be fastened to inner side surfaces of the first and second ceiling joists, respectively, the inner side surfaces facing the housing.

The first and second fastening plates may be positioned outboard of the first and second ceiling joists.

The first and second fastening plates may be fastened to outer side surfaces of the first and second ceiling joists, respectively, the outer side surfaces facing away from the housing.

The first rail portion and the second rail portion may be separately formed and secured together to form a first rail.

The pot light assembly may further include a rail track on the side wall at the top portion of the housing, and proximal portions of the first and second rail portions may be received within the rail track.

The first rail may include first and second end portions resting on the upwardly facing surfaces of the first and second ceiling joists, respectively, and a first central portion between the first and second end portions. The first central portion may be secured to the sidewall.

The pot light assembly may further include a second rail. The second rail may have third and fourth end portions resting on upwardly facing surfaces of the first and second ceiling joists, respectively. The second rail may further have a second central portion between the third and fourth end portions. The second central portion may be secured to the side wall at the top portion of the housing and support the housing between the first and second ceiling joists such that the opening of the housing faces downwardly. The housing may be supported between the first and second rails.

The pot light assembly may further include third and fourth fastening brackets securing the second rail to the first and second ceiling joists, respectively. The third and fourth fastening brackets may have third and fourth fastening plates, respectively. The third and fourth fastening plates may be positioned below the second rail and have respective fastening holes through which a fastener fastens the first and second fastening plates to the first and second ceiling joists, respectively.

According to another aspect, a pot light assembly includes a pot light housing for housing a pot light. The pot light housing has a top portion defining a top end, an opposing bottom portion defining a bottom end and having an opening through which the pot light is receivable, and a side wall extending between the top end and the bottom end. The pot light assembly further includes first and second rail portions secured to the housing. The first and second rail portions are for resting on upwardly facing surfaces of first and second ceiling joists, respectively, and for supporting the housing between the first and second ceiling joists such that the opening of the housing faces downwardly. The first and second rail portions are secured to a side wall portion of the side wall and secured at the top portion of the housing. The first and second rail portions and the side wall portion extend generally parallel to each other. The pot light assembly further includes first and second fastening brackets secured to the first and second rail portions, respectively, for securing the first rail portion and the second rail portion to the first and second ceiling joists, respectively. The first and second fastening brackets have first and second fastening plates, respectively. The first and second fastening plates are positioned below the first rail portion and the second rail portion.

The first rail portion and the second rail portion may be separately formed and secured together to form a first rail. The first rail may have first and second end portions for resting on upwardly facing surfaces of the first and second ceiling joists, respectively. The first rail may further have a first central portion between the first and second ends portions. The first central portion may be secured to the side wall.

The fastening brackets may have respective fastening holes through which a fastener is receivable to fasten the first and second fastening plates, respectively, to the first and second ceiling joists.

The housing may include a top wall at the top end.

The first rail portion and the second rail portion may be slidable relative to each other.

The pot light assembly may further include a rail track mounted to the side wall portion. The proximal portions of the first and second rail portions may be received within the rail track.

The first and second rail portions may be movable relative to the housing along a vertical axis extending between the top and bottom ends of the housing.

The pot light assembly may further include a rail track secured to the side wall portion. The first rail portion and the second rail portion may be supported in the rail track. The rail track may be moveable relative to the housing along the vertical axis.

The pot light assembly may further include third and fourth rail portions secured to the housing. The third and fourth rail portions may be for resting on upwardly facing surfaces of the first and second ceiling joists, respectively, and for supporting the housing between the first and second ceiling joists. The pot light assembly may further include third and fourth fastening brackets for securing the third and fourth rail portions to the first and second ceiling joists, respectively. The third and fourth fastening brackets may have third and fourth fastening plates, respectively. The third and fourth fastening plates may be positioned below the third and fourth rail portions, respectively.

According to another aspect, a kit of parts includes a pot light housing for housing a pot light. The pot light housing has a top portion defining a top end, an opposing bottom portion defining a bottom end and having an opening through which the pot light is receivable, and a side wall extending between the top wall and the bottom end. The kit of parts further includes a rail track secured to the side wall at the top portion of the housing. The kit of parts further includes first and second rail portions receivable in the rail track and securable therein. The first and second rail portions are for resting on upwardly facing surfaces of first and second ceiling joists to support the housing between the first and second ceiling joists such that the opening of the housing faces downwardly. The kit of parts further includes first and second fastening brackets for securing the first and second rail portions to the first and second ceiling joists, respectively.

The first and second fastening brackets may have first and second fastening plates, respectively. The first and second fastening plates may each have a fastening hole therethrough.

The first and second rail portions may be separately formed and assemblable into a first rail for the pot light assembly.

The first and second rail portions may be slidably receivable within the rail track.

The rail track may be movable along a vertical axis extending between the top and bottom ends of the housing.

The kit of parts may further include a second rail track secured to the top portion of the housing and third and fourth rail portions receivable in the second rail track and securable therein. The third and fourth rail portions may be for resting on the upwardly facing surfaces of first and second ceiling joists. The kit of parts may further include third and fourth fastening brackets for securing the third and fourth rail portions to the first and second ceiling joists, respectively.

According to another aspect, a pot light body includes a housing for housing a pot light. The housing has a top portion defining a top end and having a top wall at the top end, an opposing bottom portion defining a bottom end and having an opening through which the pot light is receivable, and a side wall extending between the top wall and the bottom end. The pot light body further includes a first rail track secured to the side wall at the top portion of the housing. The first rail track is for receiving a first rail.

The first rail track may be movable relative to the housing along a vertical axis extending between the top and bottom ends of the housing.

The pot light body may further include a second rail track on the side wall at the top portion of the housing. The second rail track may be for slidably receiving a second rail. The housing may be between the first and second rail tracks.

The second rail track may be movable relative to the housing along the vertical axis.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

Various pot light assemblies are described herein. The pot light assemblies may generally provide for ease of installation. Particularly, as will be described in further detail, the pot light assemblies are generally configured so that they may be installed by first resting one or more rails thereof on a pair of ceiling joists, and then securing the pot light assembly to the ceiling joists. This may allow for ease of installation as the pot light assembly need not necessarily be held up manually while being secured to the ceiling joists, and instead may rest on the ceiling joists. Furthermore, this may allow for temporary installation. For example, a set of pot light assemblies may be temporarily installed by resting the rails thereof on the ceiling joists of a room in a desired layout, without securing the pot light assemblies to the ceiling joists. Prior to securing the pot light assemblies to the ceiling joists, the layout may be inspected. If it is desired to change the layout, this may be done without having to unsecure the pot light assemblies from the ceiling joists. If it is not desired to change the layout, the pot light assemblies can then be secured to the ceiling joists.

Figure 1:
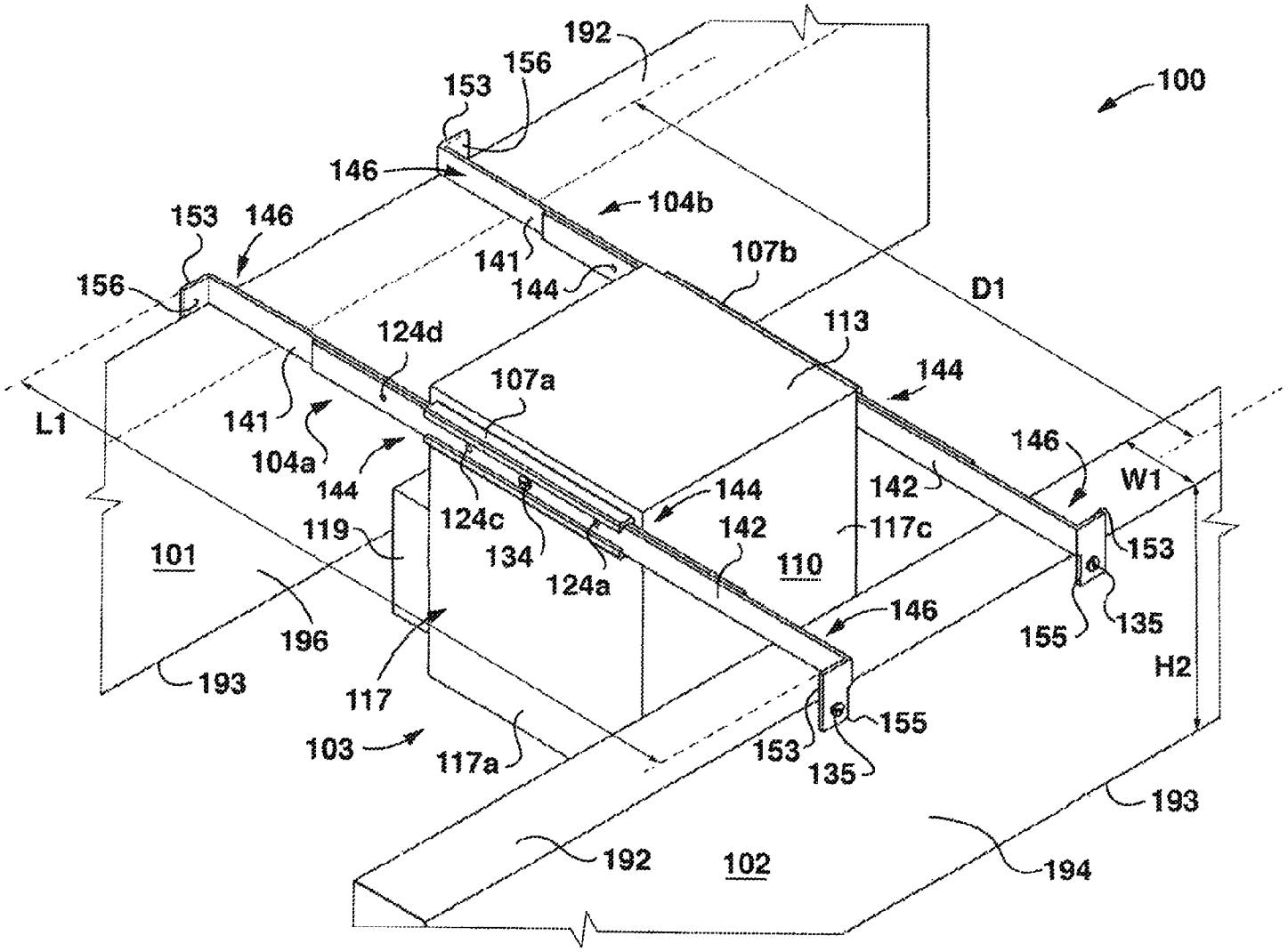
FIG. 1 is a perspective view of an example pot light assembly installed between a pair of ceiling joists.

Referring to FIG. 1, an example pot light assembly 100 is shown. In the example shown, the pot light assembly 100 is of the type known as an "Insulation Contact" or "IC" pot light assembly, and may be installed for example in an attic so that it is in contact with ceiling installation.

The pot light assembly 100 is supported between two spaced apart ceiling joists 101, 102 of a ceiling. The ceiling joists 101, 102 are adjacent and parallel. The combination of the pot light assembly 100 and the ceiling joists 101, 102 may be referred to herein as a ceiling section. In the illustrated example, each of the ceiling joists 101, 102 has a height H1 of approximately 6 inches and a width W1 of approximately 2 inches. The ceiling joists 101, 102 are spaced apart by a distance D1 on center. In the illustrated example, the distance D1 is 16 inches. In other examples, the distance D1 may be, for example, 12 inches, 19.2 inches, 24 inches, or any other standard or non-standard spacing for ceiling joists.

In the example shown, the pot light assembly 100 includes a pot light body 103 (also referred to as body 103) and first and second rails 104*a*, 104*b* secured thereto. The pot light body 103 includes a pot light housing 110 (also referred to as housing 110), a junction box 119 secured to the housing 110, and first and second rail tracks 107*a*, 107*b* (also referred to as tracks 107*a*, 107*b*) secured to the housing 110. Each of the rails 104*a*, 104*b* and the tracks 107*a*, 107*b* can be manufactured from sheet metal, steel or other metals, composite materials, plastics, or other suitable materials.

Figure 2:
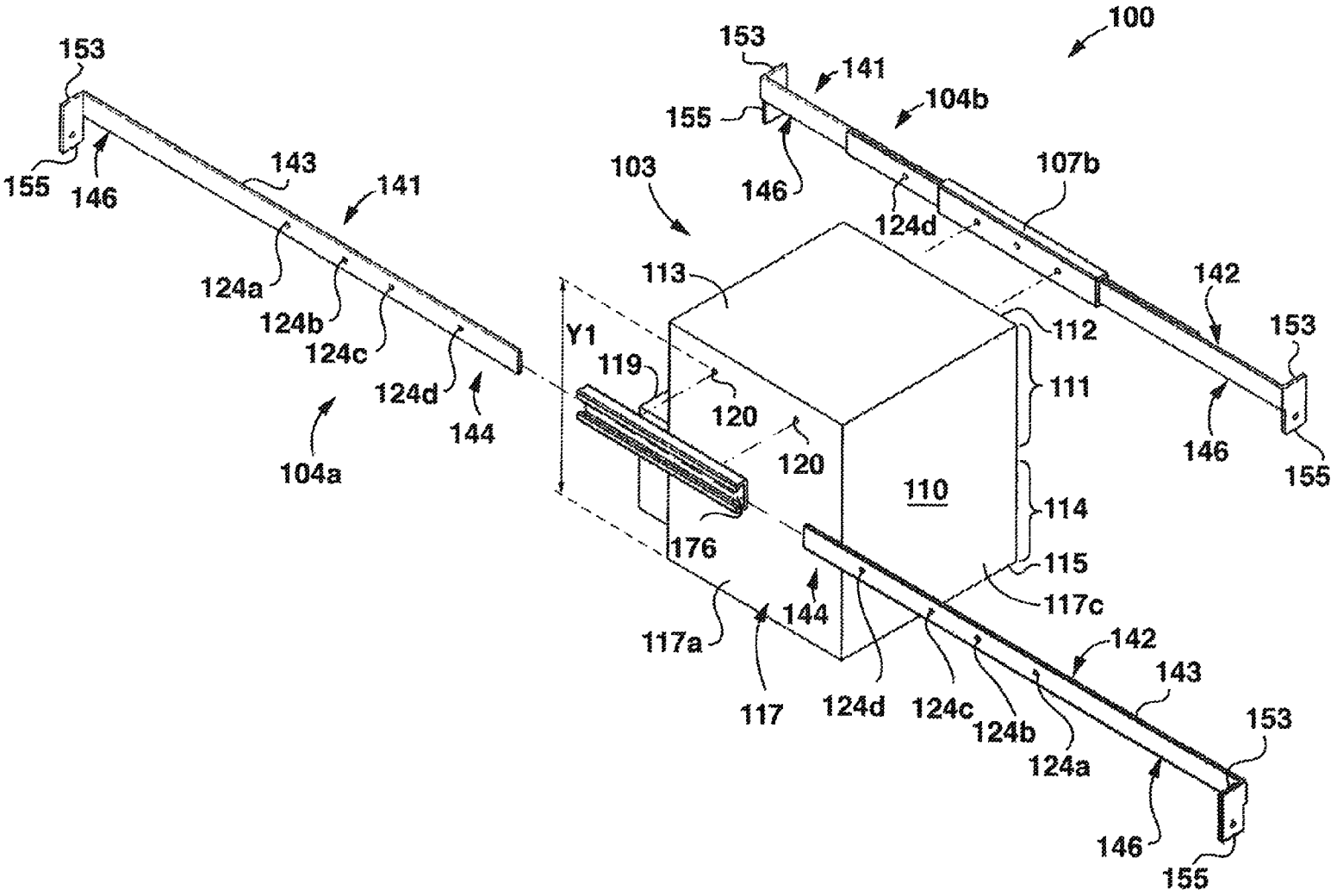
FIG. 2 is an exploded view of the pot light assembly of FIG. 1.
Figure 3:
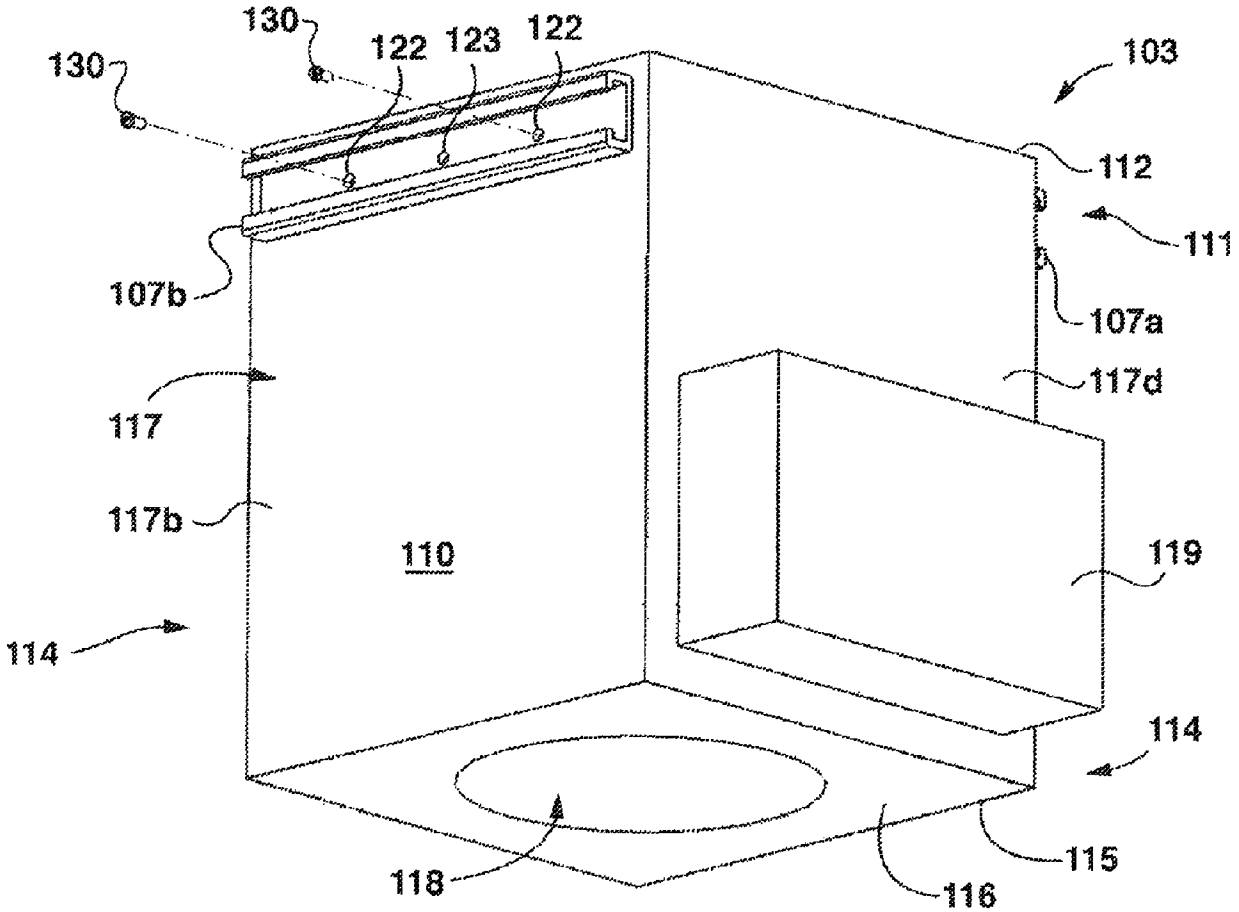
FIG. 3 is a perspective view of a pot light body of the pot light assembly of FIG. 1.

Referring to FIGS. 2 and 3, the housing 110 generally serves to support a pot light bulb. In the example shown, the housing 110 has a generally rectangular cubic shape and includes a top portion 111 defining a top end 112 and having a top wall 113 at the top end 112, and an opposing bottom portion 114 defining a bottom end 115 and having a bottom wall 116 at the bottom end 115. The housing 110 further includes a sidewall 117 extending between the top wall 113 and the bottom wall 116. In the example shown, the side wall 117 includes side wall portions 117*a-d*, with side wall portion 117*a* opposing side wall portion 117*b* and side wall portion 117*c* opposing side wall portion 117*d*. When the pot light assembly is supported on the ceiling joists, the sidewall portions 117*a-d* extend generally vertically.

In alternative examples, the housing can be any other suitable shape. In some examples, the housing may be cylindrical. In this case, the top and bottom walls can be substantially circular, and the housing can include a single cylindrical side wall portion extending between the circular top and bottom walls.

In the illustrated example, the top wall 113, bottom wall 116, and side walls portions 117*a-d* define an interior space of the housing 110. A socket assembly (not shown) may be provided in the interior space. A pot light bulb or other light source can be inserted into the interior space of the housing 110 through an opening 118 (shown in FIG. 3) of the bottom wall 116 and electrically connected to the socket assembly.

In the illustrated example, the pot light body 103 includes junction box 119, which is secured to the side wall portion 117*d*. The junction box 119 houses electrical components for connecting a power supply and wiring leads to the socket assembly within the housing 110, to provide power to the pot light.

Referring to FIG. 2, in the illustrated example, the housing 110 further includes a pair of fastening holes 120 on each of the side wall portions 117*a*, 117*b*. The holes 120 are in the top portion 111 of the housing 110, and can be used to secure the tracks 107*a*, 107*b* to the side wall portions 117*a*, 117*b*, respectively.

Referring still to FIG. 2, the holes 120 are positioned at a height Y1 from the bottom wall 116 of the housing 110. The height Y1 can in some examples be selected so that when the pot light assembly 100 is installed and the housing 110 is supported between the ceiling joists 101, 102, the bottom wall 116 of the housing 110 is generally vertically aligned with the bottoms 193 of the ceiling joists 101, 102. In examples in which the ceiling joists 101, 102 have a height H1 of approximately 6 inches, the height Y1 can be, for example, between 6 to 7 inches.

Referring to FIG. 3, in the example shown, the tracks 107*a*, 107*b* are secured to and extend along the side wall portions 117*a*, 117*b*, respectively, at the top portion 111 of the housing 110. The tracks 107*a*, 107*b* are parallel to one another and secured to the housing 110 at substantially the same height. Because the tracks 107*a*, 107*b* are substantially similar and essentially mirror images of one another, the same reference numerals are used to illustrate features of both the tracks 107*a*, 107*b*, and only the track 107*a* will be described for brevity, unless stated otherwise.

Figure 4A:
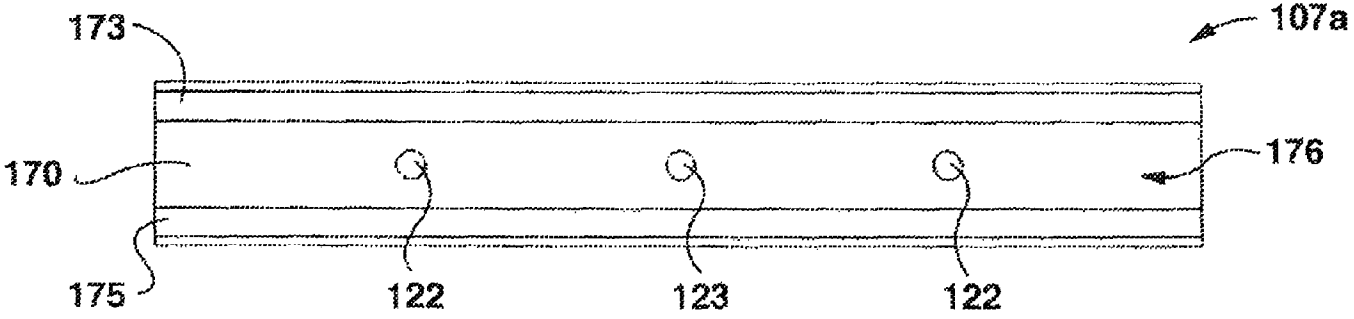
FIGS. 4A and 4B are front and side views, respectively, of a rail track of the pot light assembly of FIG. 1.
Figure 4B:
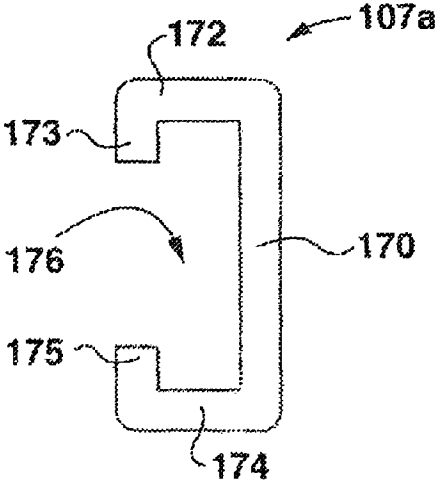

Referring to FIGS. 4A and 4B, in the example shown, the track 107*a* has a substantially C-shaped cross section with an elongate mounting plate 170 having top and bottom flanges 172, 174 extending away from opposing longitudinal edges of the mounting plate 170. The top and bottom flanges 172, 174 have respective lip portions 173, 175. The lip portions 173, 175 curve away from respective outer longitudinal edges of the top and bottom flanges 172, 174 and inwardly toward one another. In alternative examples, the lip portions 173, 175 may be omitted. The mounting plate 170, top and bottom flanges 172, 174, and lip portions 173, 175 define an interior channel 176 shaped for slidably receiving and supporting the rail 104*a* (and with respect to the track 107*b*, for slidably receiving and supporting the rail 104*b*).

In the example shown, the mounting plate 170 includes a pair of fastening holes 122 for securing the track 107*a* to the side wall portion 117*a* of the housing 110. The holes 122 can be spaced apart to match the spacing of the holes 120 on the side wall portion 117*a*.

As illustrated in FIG. 3 with respect to the track 107*b*, the track 107*b* can be secured to the side wall portion 117*b* by inserting fasteners 130 through the holes 122 of the track

107*b* and into the holes 120 of the side wall portion 117*b*. The track 107*a* can be secured to the side wall portion 117*a* in a similar manner.

In some examples, the fasteners 130 may be flat-head screws. In this case, the holes 120 may be threaded to engage and secure the fasteners 130. In other examples, the fasteners may be bolts, rivets, or other mechanical fasteners. In other examples, the holes 120 and the holes 122 may be omitted, and the tracks 107*a*, 107*b* may be secured to the respective side wall portions 117*a*, 117*b* using an adhesive, or by being welded thereto.

Referring back to FIG. 4A, in the example shown, the mounting plate 170 further includes a fastening hole 123 for securing the rail 104*a* (and with respect to the track 107*b*, for securing the rail 104*b*).

In the example shown, the rails 104*a*, 104*b* are secured indirectly to the side wall portions 117*a*, 117*b* via the tracks 107*a*, 107*b*. In other examples, the rails 104*a*, 104*b* may be secured indirectly to the side wall portions 117*a*, 117*b* in another manner. In other examples, the tracks 107*a*, 107*b* may be omitted, and the rails 104*a*, 104*b* may be secured directly to the respective side wall portions 117*a*, 117*b* of the housing 110.

Referring back to FIGS. 1 and 2, in the example shown, the rails 104*a*, 104*b* are parallel to one another and are supported within the channels 176 of the tracks 107*a*, 107*b*, respectively. The rails 104*a*, 104*b* support the housing 110 between the ceiling joists 101, 102 such that the opening 118 of the housing 110 faces downwardly. Because the rails 104*a*, 104*b* are substantially similar and essentially mirror images of one another, the same reference numerals are used to illustrate features of both the rails 104*a*, 104*b*, and only the rail 104*a* will be described for brevity, unless stated otherwise.

In the example shown, the rail 104*a* includes first and second separately formed rail portions 141, 142 that are secured together. In other examples, the rail 104*a* may be one piece. Because the rail portions 141, 142 are substantially similar and essentially mirror images of one another, the same reference numerals are used to illustrate features of both the rail portions 141, 142, and only the rail portion 141 will be described for brevity, unless stated otherwise.

Figure 5A:
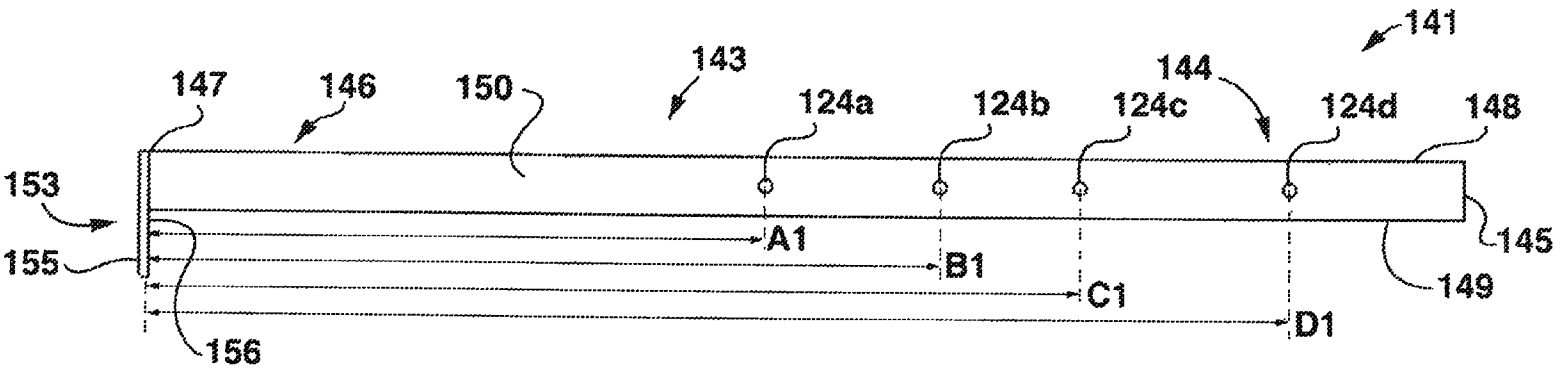
FIGS. 5A and 5B are front and side views, respectively, of a rail portion of the pot light assembly of FIG. 1.
Figure 5B:
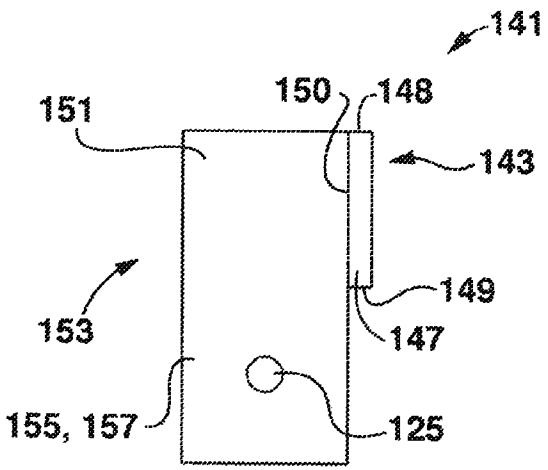

Referring to FIGS. 5A and 5B, the rail portion 141 includes a fastening bracket 153 for securing the first rail 104*a* to the ceiling joist 101, and a rigid, elongate bar 143 that is securable to the housing 110. The bar 143 has a substantially rectangular cross section. In other examples, the bar 143 may have a C-shaped cross section, a D-shaped cross section, a square cross section, a triangular cross section, or another suitable cross section. The bar 143 has a proximal portion 144 for securing to the housing 110, and an opposed distal portion 146. The proximal portion 144 has a proximal end 145, and the distal portion 146 has a distal end 147. A top longitudinal edge 148 and a bottom longitudinal edge 149 extend between the proximal and distal ends 145, 147.

In the example shown, the bar 143 includes fastening holes 124*a*, 124*b*, 124*c*, and 124*d* for securing the rail portion 141 at various positions within and to the track 107*a*. The holes 124*a*, 124*b*, 124*c*, 124*d* can be spaced from an inner surface 156 of the bracket 153 by distances A1, B1, C1, D1 respectively. In some examples, the distances A1, B1, C1, D1 can be 7, 9, 10.6, 13 inches, respectively. In other examples, additional or fewer holes may be included on the bar 143, and the holes may be at different positions.

In other examples, instead of including the holes 124*a-d*, the bar 143 may include an elongated slot (not shown) for securing the rail portion 141 at various positions within and to the track 107*a*. The slot can extend along a length of the bar 143 over the distances A1, B1, C1, D1. In such examples, the bar 143 may include notches or markings such as numbers (not shown) at each of the distances A1, B1, C1, D1 to indicate the respective distances.

In the example shown, the bracket 153 extends laterally from an outer face 150 of the bar 143 at the distal end 147, and is oriented at an angle of about 90 degrees with respect to the bar 143. The bracket 153 includes a top portion 151 that is connected to the bar 143, and an opposed bottom portion 157 that forms a fastening plate 155 (also referred to as plate 155) for securing to the ceiling joist 101. The plate 155 extends downwardly below the bottom longitudinal edge 149 of the bar 143. The plate 155 includes a fastening hole 125 for fastening the plate 155, and in turn the rail portion 141, to the ceiling joist 101 (and with respect to the rail portion 142, for fastening the plate 155, and in turn the rail portion 142, to the ceiling joist 102).

In the illustrated example, the bracket 153 is formed integrally with the bar 143, and the plate 155 is formed integrally with the remainder of the bracket 153. In other examples, the bracket 153 may be a separate component of the rail portion 141, and may be secured to the bar 143 using, for example, fasteners such as screws, bolts, rivets, or other mechanical fasteners, or by being welded thereto. Similarly, the plate 155 may be a separately formed component of the bracket 153, and the bracket may be assembled using, for example, fasteners such as screws, bolts, rivets, or other mechanical fasteners, or by welding.

Referring back to FIGS. 1 and 2, the proximal portions 144 of the rail portions 141, 142 can be slid into and supported adjacent one another within the channel 176 of the track 107*a*. The distal portions 146 of the rail portions 141, 142 can be positioned on top of and rest on the upwardly facing surfaces 192 of the ceiling joists 101, 102, respectively.

When assembled in the track 107*a* and resting on the ceiling joists 101, 102, the rail 104*a* is substantially linear, extending along a generally straight line between the outer side surfaces 194 of the ceiling joists 101, 102. The proximal portions 144 of the rail portions 141, 142 define a central portion of the rail 104*a* that supports the housing 110 between the ceiling joists 101, 102 such that the opening 118 of the housing 110 faces downwardly. The distal portions 146 of the rail portions 141, 142 define opposed end portions of the rail 104*a* between which the central portion extends, and which rest on the upwardly facing surfaces 192 of the ceiling joists 101, 102.

When assembled in the track 107*a*, the first rail portion 141 and second rail portion 142 extend generally parallel to the side wall portion 117*a*.

The plates 155 of the brackets 153 can be positioned outboard of the ceiling joists 101, 102, respectively, with the plate 155 of each bracket 153 positioned against the outer side surfaces 194 of the respective ceiling joists 101, 102. In the illustrated example, each outer side surface 194 faces away from the housing 110.

Prior to being secured to the track 107*a* and the respective ceiling joists 101, 102, the rail portions 141, 142 can slide relative to each other while supported within the channel 176 of the track 107*a*. Sliding the rail portions 141, 142 relative to each other can adjust a length L1 of the rail 104*a*, measured between the inner surfaces 156 of the brackets 153 of the rail portions 141, 142. Adjusting the length L1 of the rail 104*a* can accommodate installation of the pot light assembly 100 in various ceiling sections, as the distance D1 between ceiling joists may range from, for example, 12 to 24 inches, depending on the ceiling construction.

In the illustrated example, the rail 104*a* can be secured to the track 107*a* by sliding the rail portions 141, 142 relative to each other within the channel 176 until the holes 124*b* of each of the rail portions 141, 142 align with each other and the hole 123 of the track 107*a*. Aligning the holes 124*b* results in a length L1 of the rail 104*a* of approximately 18 inches, which is a length appropriate for installation between the ceiling joists 101, 102 having a width W1 of 2 inches and a spaced apart distance D1 of 16 inches.

A fastener 134 can then be inserted through the holes 124*b* of each of the rail portions 141, 142 and into the hole 123 of the track 107*a* to secure the rail 104*a* to the track 107*a*. In some examples, the fastener 134 may be a screw. In this case, the hole 123 may be threaded to engage and secure the fastener 134.

In other examples in which the distance D1 is 12, 19.2, or 24 inches, the rail 104*a* can be secured to the track 107*a* in a similar manner but through the holes 124*a*, 124*c*, or 124*d*, respectively.

In the illustrated example, after the distal portions 146 of the rail portions 141, 142 are positioned on top of and rest on the ceiling joists 101, 102, the plates 155 of the rail portions 141, 142 can be secured to the outer side surfaces 194 of the ceiling joists 101, 102, respectively. To secure the plates 155, a fastener 135 can be inserted through the hole 125 of each plate 155 and into the respective ceiling joists 101, 102. In some examples, the fasteners 135 can be wood screws. In other examples, the fasteners 135 may be nails, bolts, or other mechanical fasteners.

Figure 6:
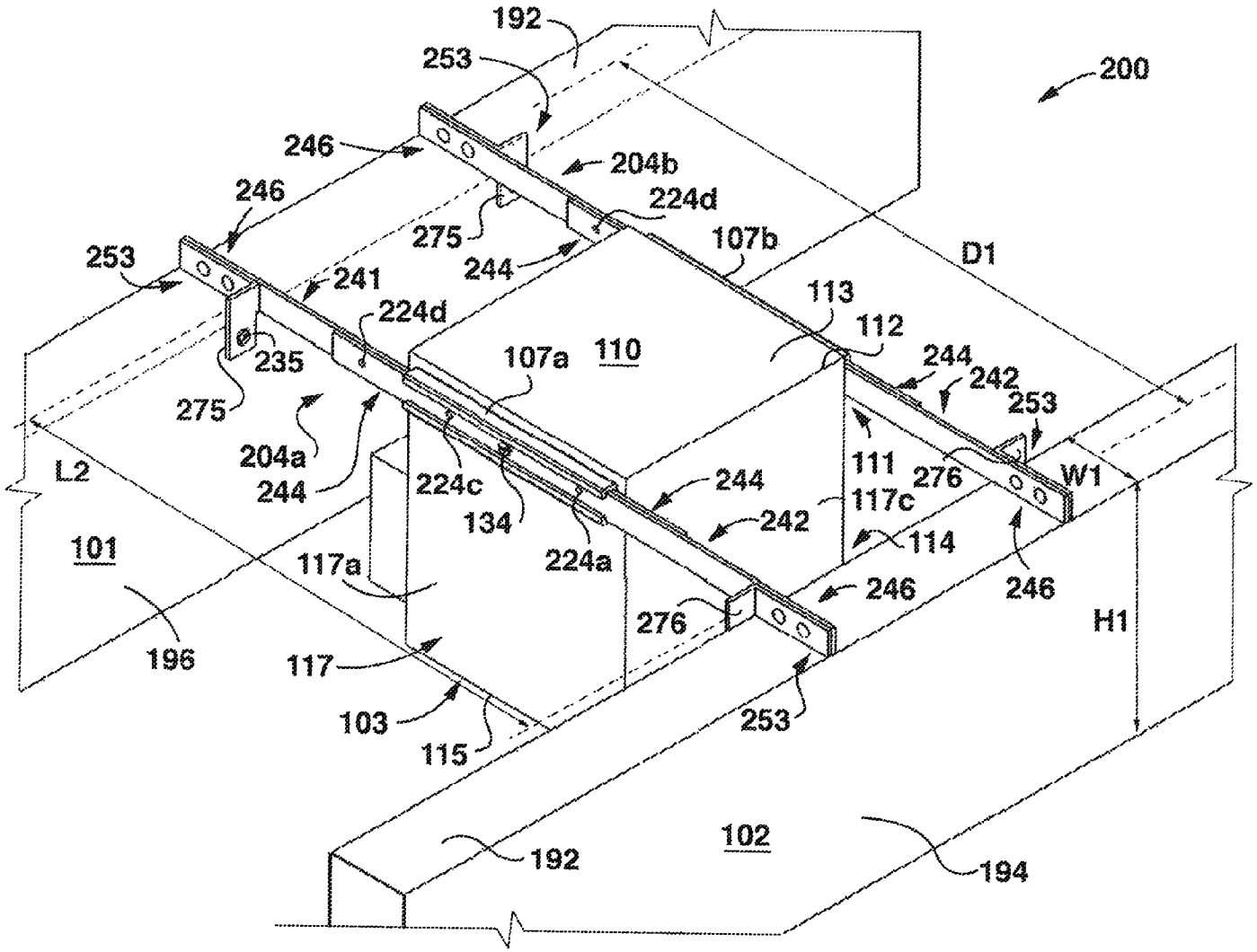
FIG. 6 is a perspective view of another example pot light assembly installed between a pair of ceiling joists.
Figure 7:
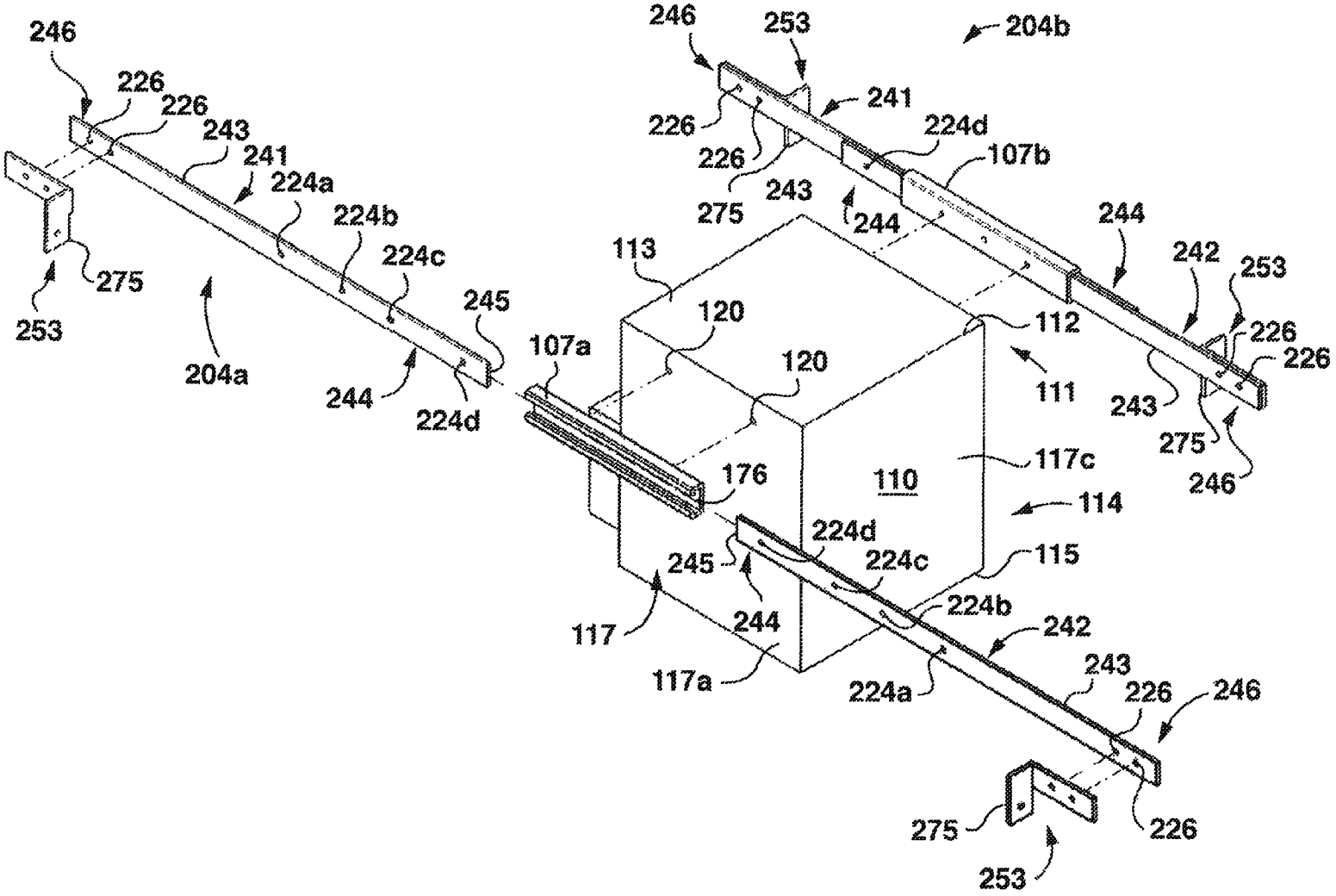
FIG. 7 is an exploded view of the pot light assembly of FIG. 6.

Referring to FIGS. 6 and 7, another example pot light assembly 200 is shown. Similar to the example described above with respect to FIG. 1, the pot light assembly 200 is supported between the ceiling joists 101, 102. The pot light assembly 200 includes the same pot light body 103 described above, but different first and second rails 204*a*, 204*b*.

Because the rails 204*a*, 204*b* are substantially similar to each other, only the rail 204*a* will be described for brevity, unless stated otherwise. Furthermore, in the illustrated example, the rail 204*a* includes first and second separately formed rail portions 241, 242. Because the rail portions 241, 242 are substantially similar, only the rail portion 241 will be described for brevity, unless stated otherwise.

Figure 8A:
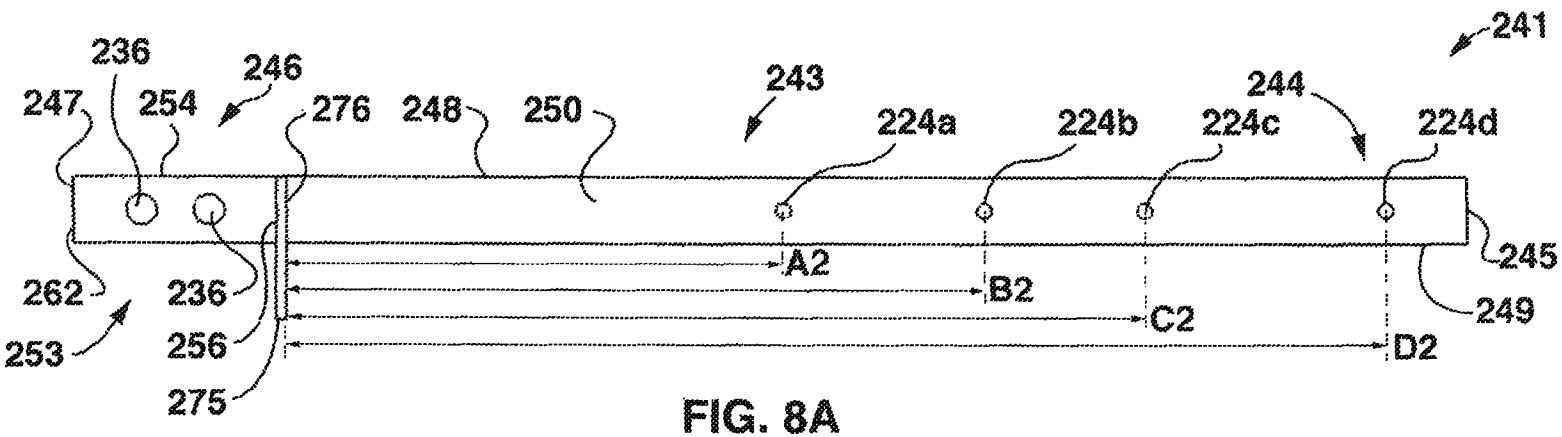
FIGS. 8A and 8B are front and top views, respectively, of a rail portion of the pot light assembly of FIG. 6.
Figure 8B:
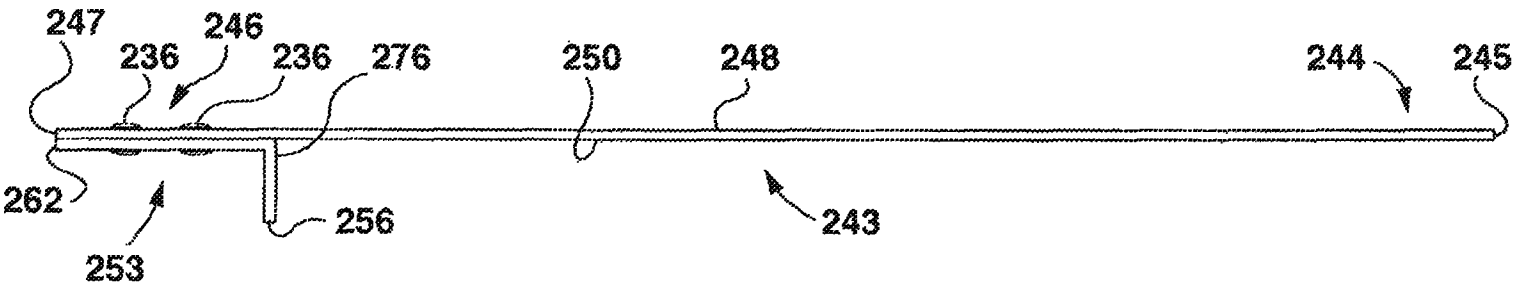

Referring to FIGS. 8A and 8B, in the example shown, the rail portion 241 includes a fastening bracket 253 and an elongate bar 243 having a rectangular cross section. In other examples, the bar 243 may have a C-shaped cross section, a D-shaped cross section, a square cross section, a triangular cross section, or any other suitable cross section. The bar 243 has a proximal portion 244 having a proximal end 245 and a distal portion 246 having a distal end 247. A top longitudinal edge 248 and a bottom longitudinal edge 249 extend between the proximal and distal ends 245, 247.

In the example shown, the bar 243 further includes fastening holes 224*a*, 224*b*, 224*c*, and 224*d* for securing the rail portion 241 at various positions to the track 107*a*. The holes 224*a*, 224*b*, 224*c*, 224*d* of the bar 243 can be spaced from an outer surface 276 the bracket 253 by distances A2, B2, C2, D2, respectively. In some examples, the distances A2, B2, C2, D2 can be 5, 7, 8.6, 11 inches, respectively. In other examples, additional or fewer holes may be included on the bar 243, and the holes may be at different positions.

In other examples, instead of including the holes 224*a-d*, the bar 243 may include an elongated slot (not shown) for securing the rail portion 241 at various positions within and to the track 107*a*. The slot can extend along a length of the bar 243 over the distances A2, B2, C2, D2. In such examples, the bar 243 may include notches or markings such as numbers (not shown) at each of the distances A2, B2, C2, D2 to indicate the respective distances.

In the example shown, the bar 243 further includes a pair of fastening holes 226 for fastening the bracket 253 to the bar 243 (shown in FIG. 7).

Figure 9B:
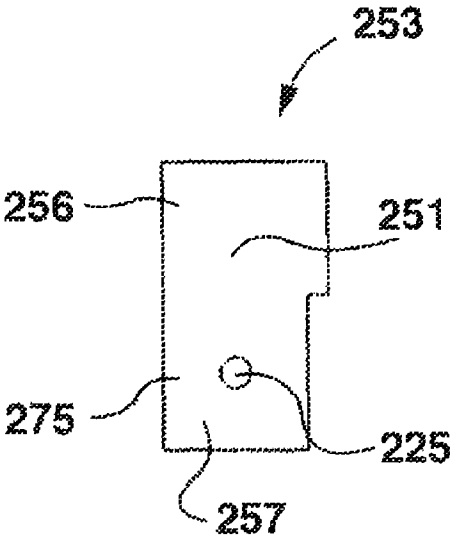
FIGS. 9A and 9B are front and side views, respectively, of a bracket of the pot light assembly of FIG. 6.
Figure 9A:
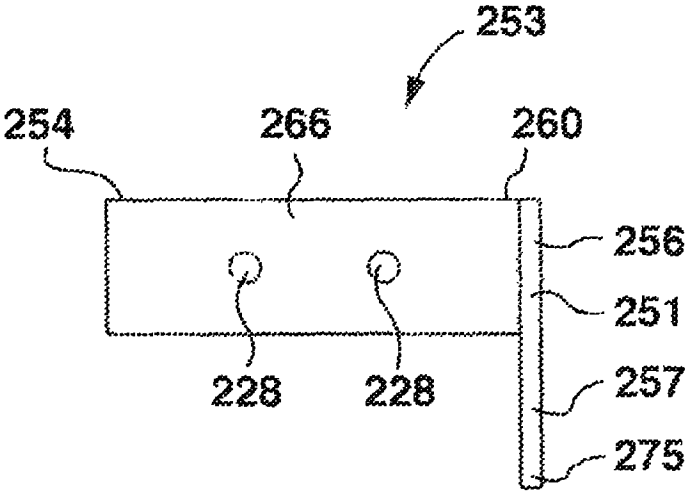

Referring to FIGS. 9A and 9B, in the example shown, the bracket 253 includes a mounting plate 254 and a flange 256. The mounting plate 254 includes a pair of fastening holes 228 for fastening the bracket 253 to the bar 243. The holes 228 can be spaced apart to match the spacing of the holes 226 of the bar 243.

The flange 256 extends laterally from an outer face 266 of the mounting plate 254 at a proximal end 260 of the mounting plate 254, and is oriented at an angle of about 90 degrees with respect to the mounting plate 254. The flange 256 includes a top portion 251, and an opposed bottom portion 257 that forms a fastening plate 275 for securing to the ceiling joist 101. The fastening plate 275 extends below the mounting plate 254. The fastening plate 275 has a fastening hole 225 for fastening the fastening plate 275, and in turn the rail portion 241, to the ceiling joist 101 (and with respect to the rail portion 242, for fastening the fastening plate 275, and in turn the rail portion 242, to the ceiling joist 102).

Referring back to FIGS. 8A and 8B, the bracket 253 can be secured against an outer face 250 of the bar 243. A distal end 262 of the mounting plate 254 can be positioned at, proximate, or towards the distal end 247 of the bar 243. The bracket 253 can be positioned and oriented such that the flange 256 extends laterally away from the outer face 250 of the bar 243, is positioned longitudinally inwardly of the distal end 247 of the bar 243, and the fastening plate 275 extends downwardly below the bottom longitudinal edge 249 of the bar 243.

Fasteners 236 can be inserted through the holes 228 of the bracket 253 and the holes 226 of the bar 243 to secure the bracket 253 to the bar 243. In some examples, the fasteners 236 can be rivets. In other examples, the fasteners 236 may be screws, bolts, or other mechanical fasteners. In other examples, the holes 228 of the bracket 253 and the holes 226 of the bar 243 may be omitted, and the bracket 253 may be secured to the bar 243 using an adhesive, or by being welded thereto.

Referring back to FIGS. 6 and 7, the proximal portions 244 of the rail portions 241, 242 can be slid into and supported adjacent one another within the channel 176 of the track 107*a*. The distal portions 246 of the rail portions 241, 242 can be positioned on top of and rest on the upwardly facing surfaces 192 of the ceiling joists 101, 102.

When assembled in the track 107*a* and resting on the ceiling joists 101, 102, the rail 204*a* is substantially linear, extending along a nearly straight line between the outer side surfaces 194 of the ceiling joists 101, 102. The proximal portions 244 of the rail portions 241, 242 define a central portion of the rail 204*a* that supports the housing 110 between the ceiling joists 101, 102 such that the opening 118 of the housing 110 faces downwardly. The distal portions 246 of the rail portions 241, 242 define end portions of the rail 204*a* between which the central portion extends, and which rest on the upwardly facing surfaces 192 of the ceiling joists 101, 102.

The fastening plates 275 of the brackets 253 can be positioned inboard of (i.e., between) the ceiling joists 101, 102, respectively, with the plate 275 of each bracket 253 positioned against the inner side surface 196 of the respective ceiling joists 101, 102. In the illustrated example, each inner side surface 196 faces the housing 110.

Prior to being secured to the track 107*a* and the respective ceiling joists 101, 102, the rail portions 241, 242 can slide relative to each other while supported within the channel 176 of the track 107*a*. Sliding the rail portions 241, 242 relative to each other can adjust a length L2 of the rail 204*a* measured between the outer surfaces 276 of the brackets 253 of the rail portions 141, 142. Adjusting the length L2 of the rail 204*a* can accommodate installation of the pot light assembly 200 in various ceiling sections, as the distance D1 between ceiling joists may range from, for example, 12 to 24 inches, depending on the ceiling construction.

In the illustrated example, the rail 204*a* can be secured to the track 107*a* by sliding the rail portions 241, 242 relative to each other within the channel 176 until the holes 224*b* of each of the rail portions 241, 242 align with each other and the hole 123 of the track 107*a*. Aligning the holes 224*b* results in a length L2 of the rail 204*a* of approximately 14 inches, which is a length appropriate for installation between the ceiling joists 101, 102 having a width W1 of 2 inches and a spaced apart distance D1 of 16 inches.

The fastener 134 can then be inserted through the holes 224*b* of each of the rail portions 241, 242 and into the hole 123 of the track 107*a* to secure the rail 204*a* to the track 107*a*.

In other examples in which the distance D1 is 12, 19.2, or 24 inches, the rail 204*a* can be secured to the track 107*a* in a similar manner but through the holes 224*a*, 224*c*, or 224*d*, respectively.

In the illustrated example, the plates 275 of the rail portions 241, 242 can be secured to the inner side surfaces 196 of the ceiling joists 101, 102, respectively. To secure the plates 275, a fastener 235 can be inserted through the hole 225 of each plate 275 and into the respective ceiling joists 101, 102. In some examples, the fasteners 235 can be wood screws. In other examples, the fasteners 235 may be nails, bolts, or other suitable mechanical fasteners.

Figure 10:
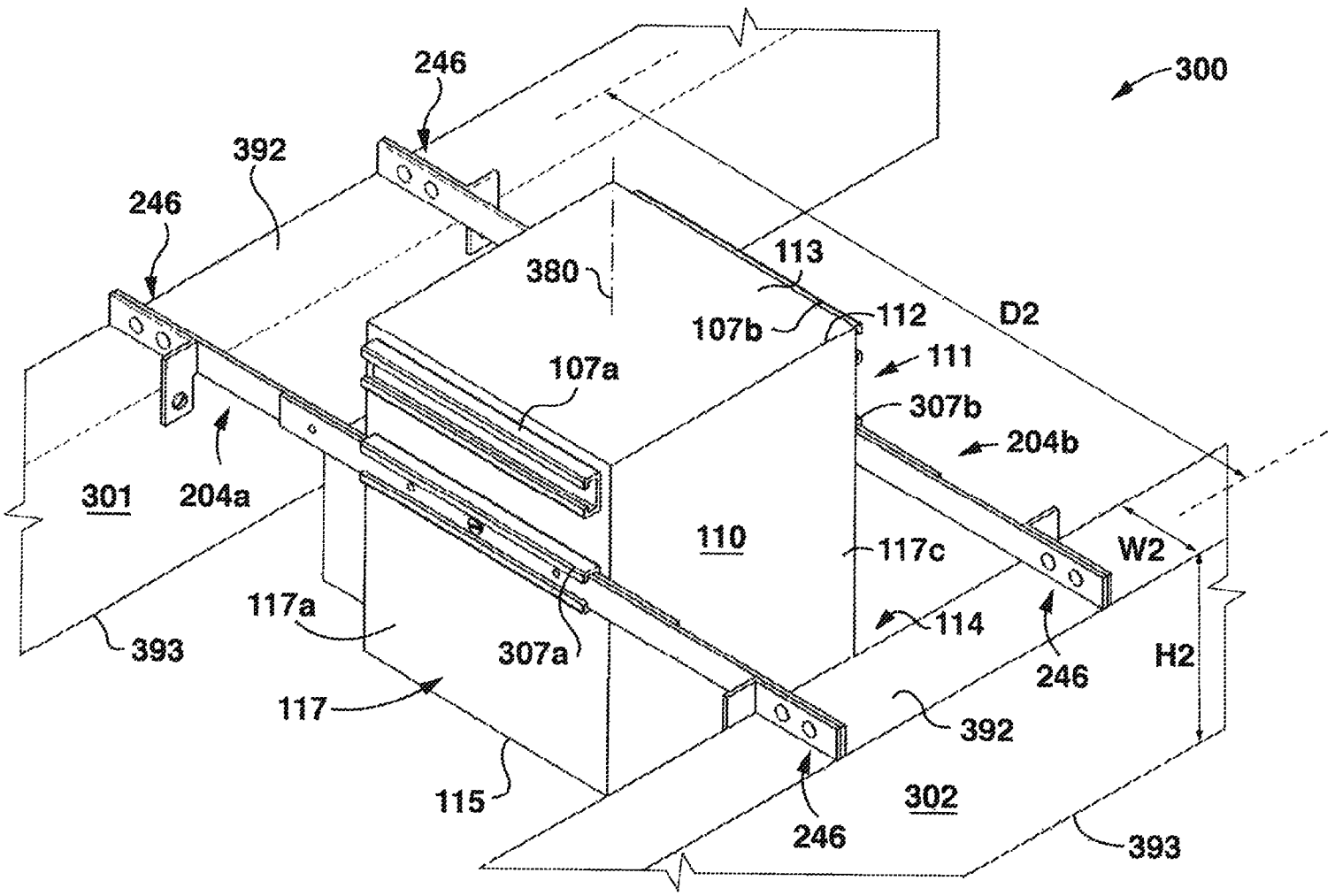
FIG. 10 is a perspective view of another example pot light assembly installed between a pair of ceiling joists.
Figure 11:
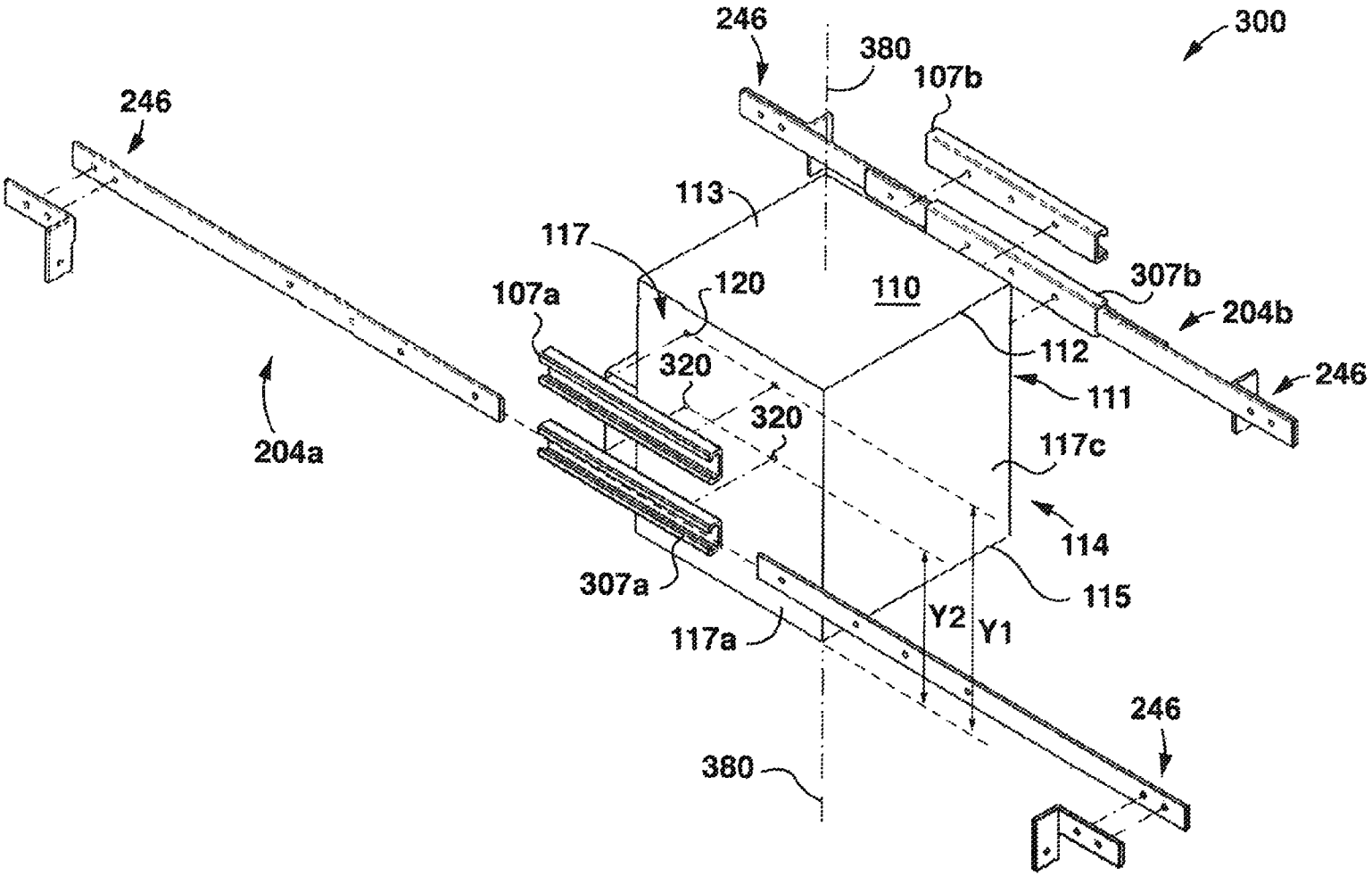
FIG. 11 is an exploded view of the pot light assembly of FIG. 10.

Referring to FIGS. 10 and 11, another example pot light assembly 300 is shown. The pot light assembly 300 is supported between two spaced apart ceiling joists 301, 302 of a ceiling section. In the illustrated example, each of the ceiling joists 301, 302 has a height H2 of approximately 4 inches and a width W2 of approximately 2 inches. The ceiling joists 301, 302 are spaced apart by a distance D2 measured on center.

The pot light assembly 300 is similar to the pot light assembly 200. However, the housing 110 of the pot light assembly 300 has a second pair of fastening holes 320 on each of the side wall portions 117*a*, 117*b*. The holes 320 can be used to secure third and fourth rail tracks 307*a*, 307*b* to the side wall portions 117*a*, 117*b*.

The tracks 307*a*, 307*b* are substantially similar to the tracks 107*a*, 107*b* described above. Further, the tracks 307*a*, 307*b* can be secured to the respective side wall portions 117*a*, 117*b* via the holes 320 similar to how the tracks 107*a*, 107*b* are secured via the holes 120. The description of the tracks 307*a*, 307*b* will therefore be omitted for brevity.

The holes 320 can be positioned at the top portion 111 of the housing 110 below the holes 120. The holes 320 can be positioned at a height Y2 from the bottom wall 116 of the housing 110. The height Y2 can be selected so that when the pot light assembly 100 is installed and supported between the ceiling joists 301, 302, the bottom wall 116 of the housing 110 is generally vertically aligned with the bottoms 393 of the ceiling joists 301, 302. In examples in which the ceiling joists 301, 302 have a height H2 of approximately 4 inches, the height Y2 can be between 4 to 5 inches.

As a result of having two sets of rail tracks, the position at which the rails 204*a*, 204*b* are secured to the housing 110 can be adjusted to accommodate installation on different types of ceiling joists. The position can be adjusted by moving the rails 204*a*, 204*b* relative to the housing 110 along a vertical axis 380 extending between the top and bottom ends 112, 115 of the housing 110, to secure the rails 204*a*, 204*b* within either of the tracks 107*a*, 107*b* or the tracks 307*a*, 307*b*.

For example, as illustrated in FIG. 11, the tracks 307*a*, 307*b* can be used to install the pot light assembly 300 between the ceiling joists 301, 302 having a height H2 of 4 inches. In this case, the rails 204*a*, 204*b* can be moved relative to the housing 110 along the axis 380 and secured within the tracks 307*a*, 307*b*, respectively, with the distal portions 246 of the rails 204*a*, 204*b* resting on the upwardly facing surfaces 392 of the ceiling joists 301, 302.

In another example, the tracks 107*a*, 107*b* can be used to install the pot light assembly 300 between ceiling joists having a height H1 of 6 inches, such as the ceiling joists 101, 102 illustrated in FIGS. 1 and 6. In this case, the rails 204*a*, 204*b* can be moved relative to the housing 110 along the axis 380 and secured within the tracks 107*a*, 107*b*, with the distal portions 246 of the rails 204*a*, 204*b* resting on the upwardly facing surfaces 192 of the ceiling joists 101, 102.

In other examples, the tracks 307*a*, 307*b* may be omitted. In this case, the tracks 107*a*, 107*b* can be moved relative to the housing 110 along the axis 380 and secured to the housing 110 at various positions, to accommodate installation on different types of ceiling joists.

For example, if the pot light assembly 300 is to be installed between the ceiling joists 101, 102 having a height H1 of 6 inches, then the tracks 107*a*, 107*b* can remain secured to the housing 110 via the holes 120. If the pot light assembly 300 is to be installed between the ceiling joists 301, 302 having a height H2 of 4 inches, then the tracks 107*a*, 107*b* can be moved relative to the housing 110 along the axis 380 and secured to the housing 110 via the holes 320.

In the example shown, the rails 204*a*, 204*b* are secured indirectly to the side wall portions 117*a*, 117*b* via the tracks 307*a*, 307*b*. In other examples, the rails 204*a*, 204*b* may be secured indirectly to the side wall portions 117*a*, 117*b* in another manner. In other examples, both sets of the tracks 107*a*, 107*b* and 307*a*, 307*b* may be omitted, and the rails 204*a*, 204*b* can be secured directly to the housing 110.

In some examples, the pot light assembly 300 can include the rails 104*a*, 104*b* in place of the rails 204*a*, 204*b*.

Figure 12A:
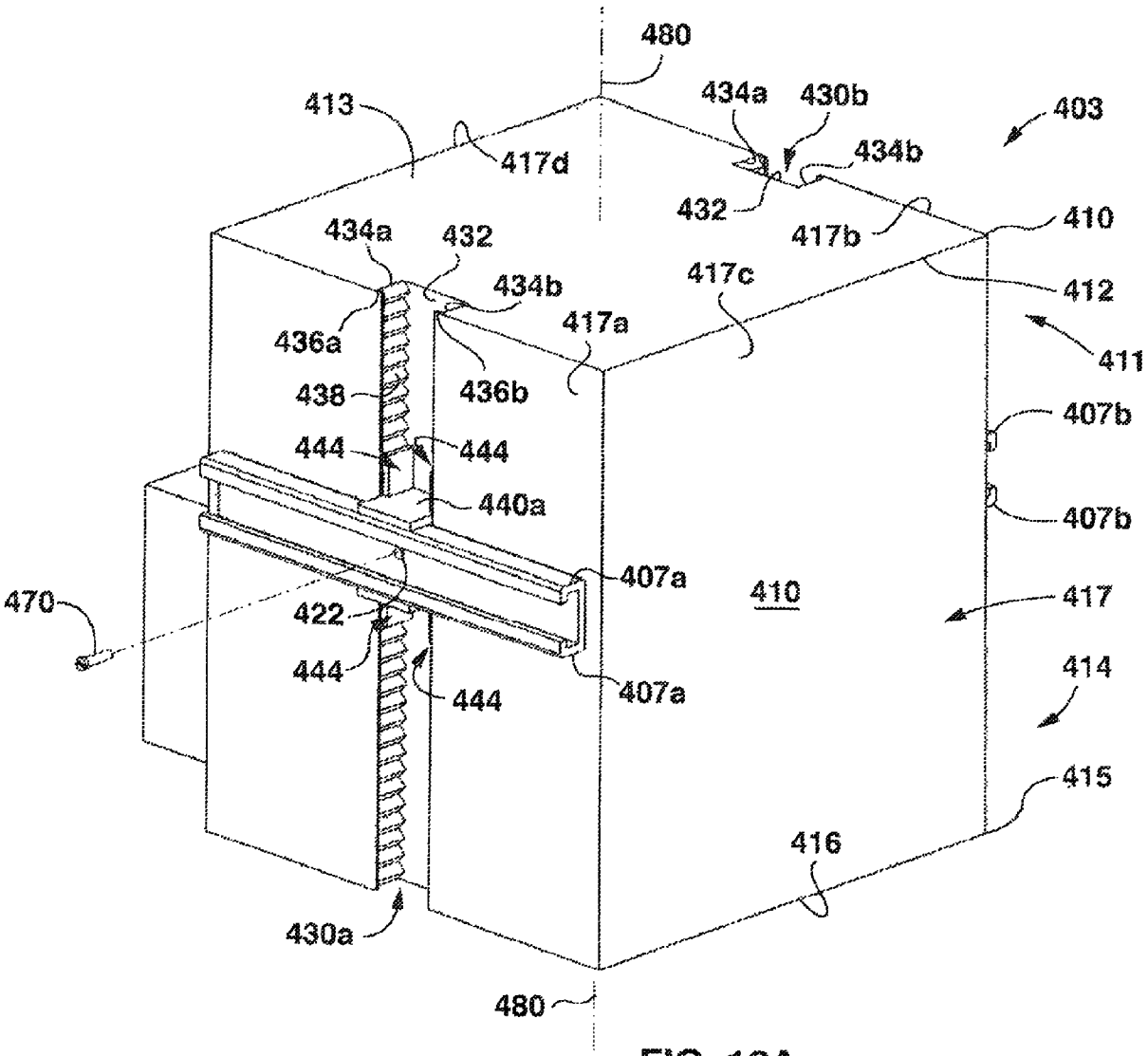
FIG. 12A is a perspective view of another example pot light body, with rail tracks positioned near the middle of the pot light body.
Figure 12B:
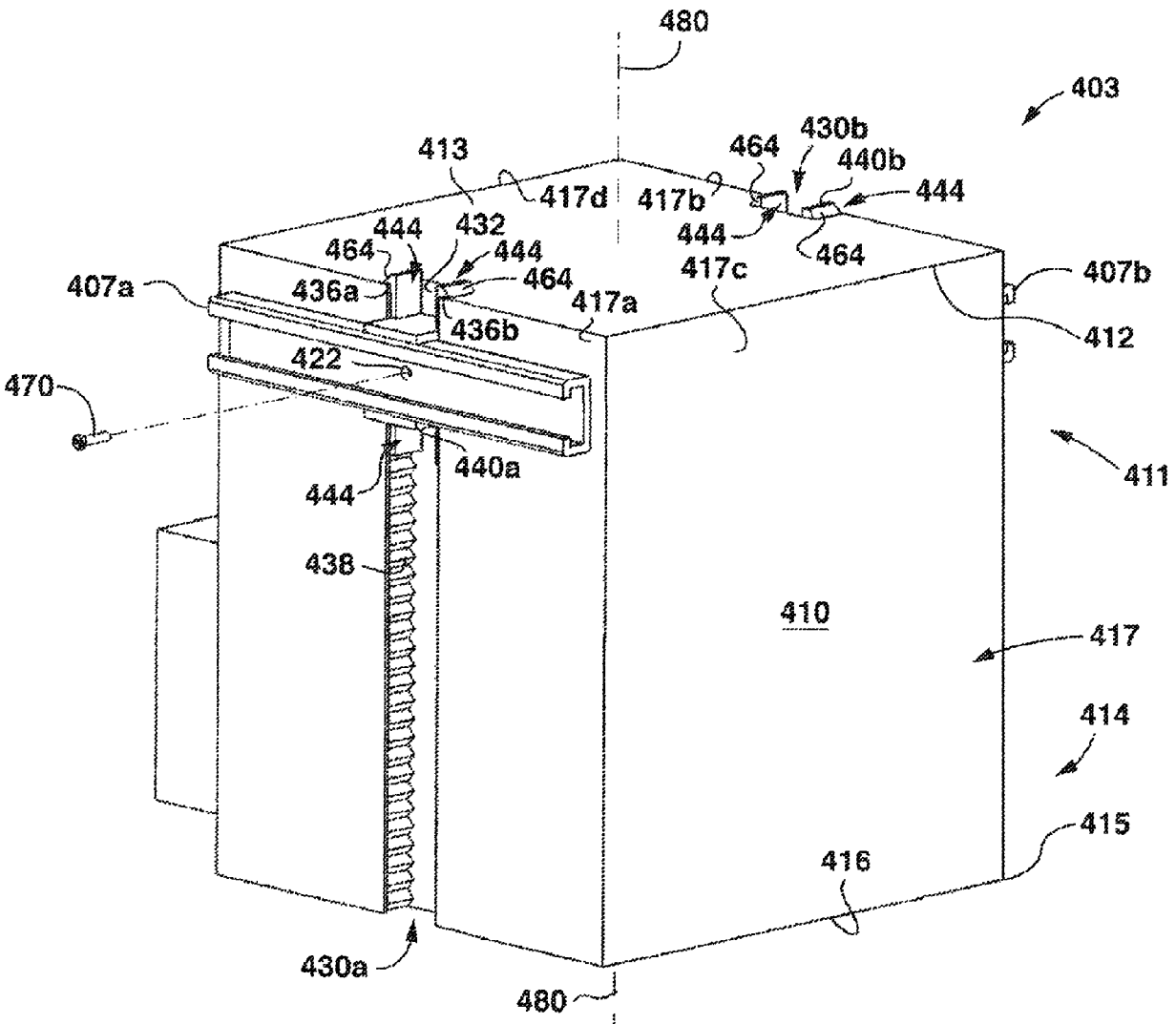
FIG. 12B is a perspective view of the pot light body of FIG. 12A, with rail tracks positioned near the top end of the pot light body.
Figure 13:
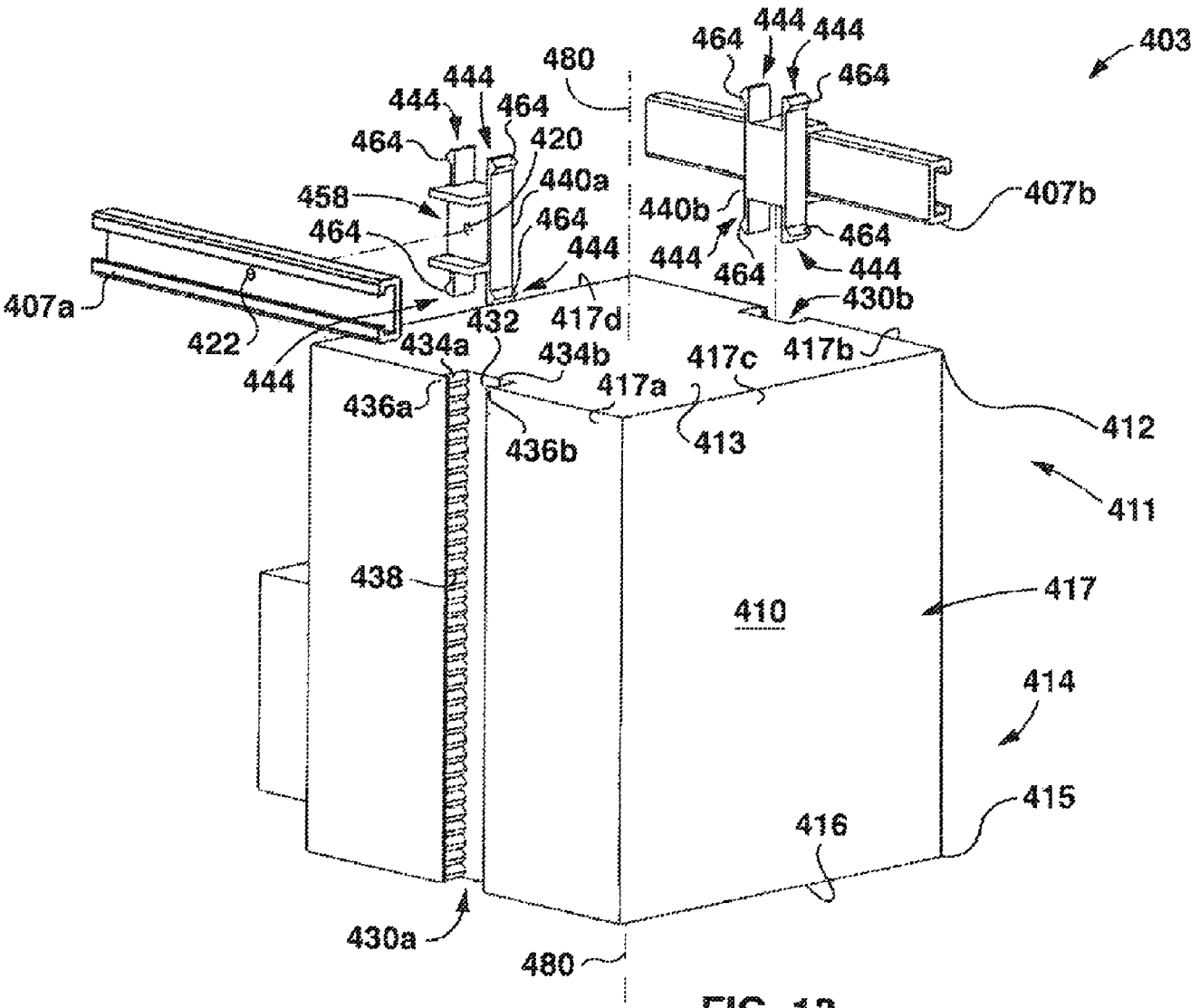
FIG. 13 is an exploded view of the pot light body of FIGS. 12A and 12B.

Referring to FIGS. 12A to 13, another example pot light body 403 is shown. The pot light body 403 can be used in the pot light assemblies 100 and 200 in place of the pot light body 103. The pot light body 403 includes a pot light housing 410, first and second support members 440*a*, 440*b*, and first and second rail tracks 407*a*, 407*b*. The tracks 407*a*, 407*b* are substantially similar to the tracks 107*a*, 107*b* described above, but include only one fastening hole (422).

In the example shown, the housing 410 is similar to the housing 110 described above. The housing 410 has a generally rectangular shape and includes a top portion 411 defining a top end 412 and having a top wall 413 at the top end 412, and an opposing bottom portion 414 defining a bottom end 415 and having a bottom wall 416 at the bottom end 415. The housing 410 further includes a side wall 417 extending between the top wall 413 and the bottom wall 416. In the example shown, the side wall 417 includes side wall portions 417*a-d*, with side wall portion 417*a* opposing side wall portion 417*b* and side wall portion 417*c* opposing side wall portion 417*d*.

The side wall portions 417*a*, 417*b* have respective recessed channels 430*a*, 430*b* extending vertically between the top wall 413 and the bottom wall 416 of the housing 410. Because the channels 430*a*, 430*b* are substantially similar, only the channel 430*a* will be described for brevity, unless stated otherwise. Similarly, because the support members 440*a*, 440*b* are substantially similar, only the support member 440*a* will be described for brevity, unless stated otherwise.

In the example shown, the channel 430*a* is defined by an end wall 432, and opposing side wall portions 434*a*, 434*b* extending between the side wall portion 417*a* and the end wall 432. Portions of the side wall portion 417*a* extend past the side walls 434*a*, 434*b* to provide lip portions 436*a*, 436*b* opposing the end wall 432 and partially enclosing the channel 430*a*. Each of the side walls 434*a*, 434*b* includes a plurality of horizontal ribs 438 positioned adjacent one another along the vertical length of the side walls 434*a*, 434*b*, with each rib 438 extending between respective lip portions 436*a*, 436*b* and the end wall 432.

Figure 14B:
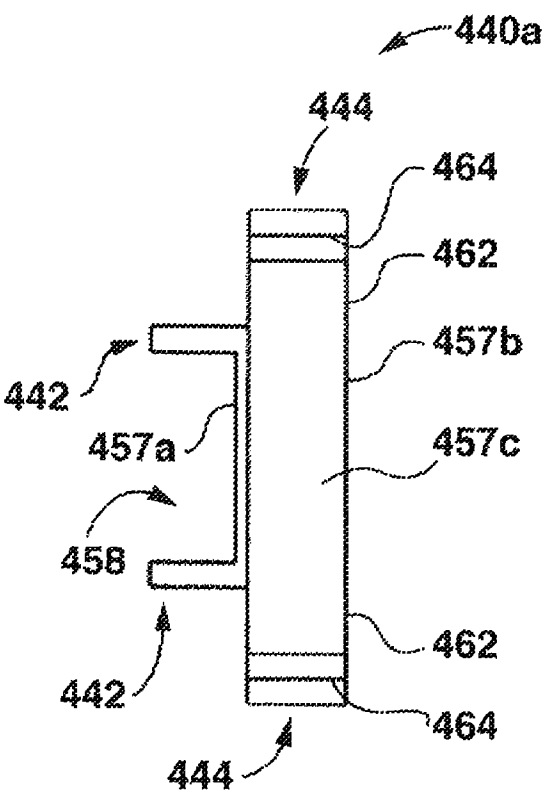
FIGS. 14A and 14B are front and side views, respectively, of a support member of the pot light body of FIGS. 12A and 12B.
Figure 14A:
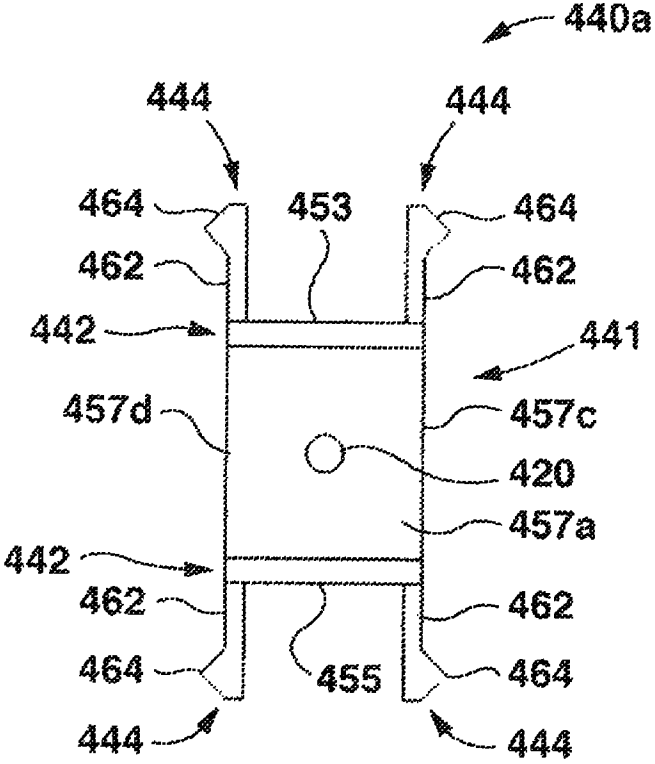

Referring to FIGS. 14A and 14B, in the example shown, the support member 440*a* includes a body 441, a pair of support flanges 442, and four arms 444. The body 441 is generally rectangular with a top wall 453, a bottom wall 455, and four side walls 457*a-d* extending between the top and bottom walls 453, 455. The side wall 457*a* can include a fastening hole 420 for securing the track 407*a* and either of the rail 104*a* or 204*a* described above.

A pair of the arms 444 are positioned at opposing sides on the top wall 453 of the body 441, and extend upwardly from the top wall 453. Another pair of the arms 444 are positioned at opposing sides on the bottom wall 455 of the body 441, and extend downwardly from the bottom wall 455. Each arm 444 has an elongate body 462 and a tooth 464 at the distal end of the elongate body 462. The teeth 464 extend outwardly away from the respective bodies 462 past the respective side walls 457*c*, 457*d* of the body 441.

The pair of support flanges 442 are positioned at opposing top and bottom ends of the side wall 457*a* of the body 441, and extend outwardly away from the side wall 457*a*. The support flanges 442 and the side wall 457*a* define a channel 458 for receiving and supporting the track 407*a*.

Referring back to FIGS. 12A to 13, the support member 440*a* can be positioned within the channel 430*a*. The teeth 464 of the support member 440*a* can extend between and engage a set of the ribs 438 within the channel 430*a* to hold the support member 440*a* in place. In response to the support member 440*a* being pushed upwards or downwards within the channel 430*a*, the teeth 464 may hit against the set of the ribs 438, resulting in the arms 444 of the support member 440*a* flexing inwardly. The inward flexure can allow the teeth 464 to move past the set of the ribs 438 to be supported by a different set of the ribs 438. The support member 440*a* can thus be moved to and supported at various positions along the vertical length of the channel 430*a*.

The track 407*a* can be supported within the channel 458 of the support member 440*a* and secured therein. By moving the support member 440*a* upwards or downwards within the channel 430*a*, the track 407*a*, and any rail supported within the track 407*a*, can thus be moved relative to the housing 110 along a vertical axis 480 extending between the top and bottom ends 412, 415 of the housing 410. In this way, the position at which the track 407*a* and any rail supported therein are secured to the housing 110 can be adjusted to accommodate installation on different types of ceiling joists.

The track 407*a* and any rail supported therein may be secured to the support member 440*a* using the fastener 470. For example, the rail 104*a* described above can be slid into and supported within the track 407*a*. The fastener 470 can then be inserted through the holes 124*b* of each of the rail portions 141, 142 of the rail 104*a*, through the hole 422 of the track 407*a*, and into the hole 420 of the support member 440*a*.

In some examples, the fastener 470 may be a screw. In this case, the hole 420 may be threaded to engage and secure the fastener 470. As the fastener 470 is tightened, the rail 104*a* is pressed against the track 407*a*, and the track 407*a* and the support member 440*a* are pressed together. In turn, the teeth 464 of the support member 440*a* can press against the lip portions 436*a*, 436*b*, thus securing the support member 440*a* within the channel 430*a*.

In some examples, the track 407*a* may be omitted, and either of the rail 104*a* or the rail 204*a* can be secured within the channel 458 of the support member 440*a*.

Figure 15:
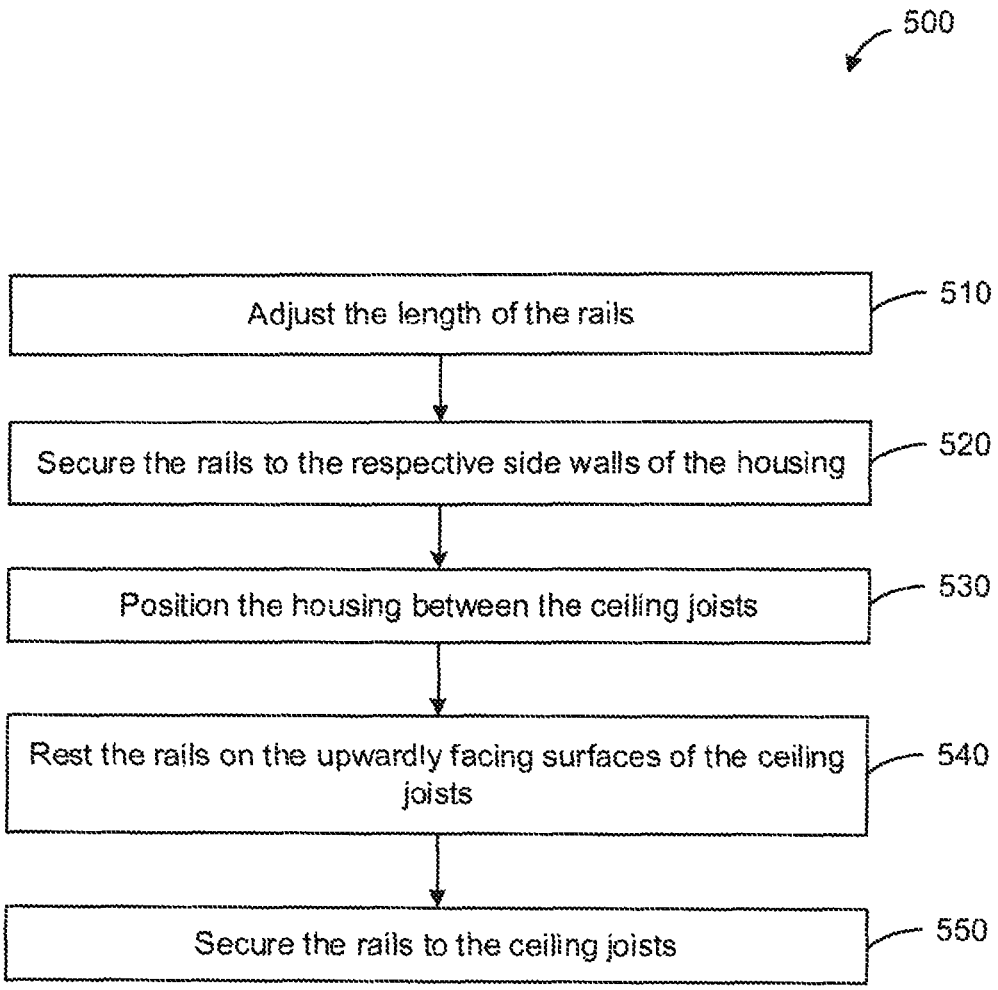
FIG. 15 is a flow chart illustrating an example method of installing the pot light assembly of FIG. 1.

Referring to FIG. 15, a method 500 for installing the pot light assemblies described above will generally be described with respect to the pot light assembly 100 of FIG. 1.

At 510, an installer can adjust the length L1 of the rails 104*a*, 104*b* to correspond to the distance D1 between the ceiling joists 101, 102. To adjust the length L1, the installer can slide the respective rail portions 141, 142 relative to each other within the respective channels 176 of the tracks 107*a*, 107*b*. In examples in which D1 is 16 inches, the installer can slide the respective rail portions 141, 142 until the respective holes 124*b* are aligned, to provide a length L1 of 18 inches.

At 520, the installer can secure the rails 104*a*, 104*b* to the respective side wall portions 117*a*, 117*b* of the housing 110. For example, the installer can insert the fastener 134 through the holes 124*b* of the respective rail portions 141, 142, and into the hole 123 of the respective tracks 107*a*, 107*b*.

At 530, the installer can position the housing 110 between the ceiling joists 101, 102, and then at 540, the installer can rest the rails 104*a*, 104*b* on the upwardly facing surfaces 192 of the ceiling joists 101, 102, respectively, so that the rails 104*a*, 104*b* support the housing 110 between the ceiling joists 101, 102 and the opening 118 faces downwardly.

In some examples, the installer can first rest the distal portions 146 of the respective rail portions 141 on the upwardly facing surface 192 of the ceiling joist 101. The installer can then rest the distal portions 146 of the respective rail portions 142 on the upwardly facing surface 192 of the ceiling joist 102. The installer can rest the rails 104*a*, 104*b* on the ceiling joists 101, 102 so that the respective fastening plates 155 of the brackets 153 are outboard of the ceiling joists 101, 102.

Resting the rails 104*a*, 104*b* on top of the ceiling joists 101, 102 can allow the installer to temporarily install a set of pot light assemblies 100 in a ceiling, to allow for inspection of the pot light layout. If the layout needs to be adjusted, then the installer can move or take down one or more of the pot light assemblies 100 without having to unscrew any fasteners.

In addition, resting the rails 104*a*, 104*b* on top of the ceiling joists 101, 102 can provide convenient access to the junction box 119. For example, an electrician may readily access the junction box 119 during installation to electrically connect the pot light assembly 110, without necessarily having to work around or position tools around the rails 104*a*, 104*b*.

At 550, the installer can secure the rails 104*a*, 104*b* to the ceiling joists 101, 102 by fastening the respective plates 155 of the brackets 153 to the outer side surfaces 194 of the ceiling joists 101, 102. To do so, the installer can insert the fasteners 135 through the holes 125 of the respective plates 155 and into the ceiling joists 101, 102. As the rails 104*a*, 104*b* rest on top of the ceiling joists 101, 102, the installer may not necessarily have to manually hold up the pot light assembly 100 while fastening the plates 155 to the ceiling joists 101, 102.

In other examples in which the rails 204*a*, 204*b* of FIG. 6 are used, at 540 the installer can rest the rails 204*a*, 204*b* on the ceiling joists 101, 102 so that the respective fastening plates 275 of the brackets 253 are inboard of (i.e., between) the ceiling joists 101, 102. Then at 550, the installer can secure the rails 204*a*, 204*b* to the ceiling joists 101, 102 by fastening the respective plates 275 of the brackets 253 to the inner side surfaces 196 of the ceiling joists 101, 102. To do so, the installer can insert the fasteners 235 through the holes 225 of the respective plates 275 and into the ceiling joists 101, 102.

In other examples in which the pot light assembly 300 of FIG. 10 is used, prior to securing the rails 204*a*, 204*b* (or 104*a*, 104*b*) to the housing 110 at 520, the installer can measure the height of the ceiling joists. The installer can then adjust the position of the rails 204*a*, 204*b* (or 104*a*, 104*b*) to correspond to the measured height by moving the rails 204*a*, 204*b* (or 104*a*, 104*b*) along the axis 380.

Similarly, in other examples in which the pot light body 403 of FIG. 12A is used, prior to securing the rails 204*a*, 204*b* (or 104*a*, 104*b*) to the housing 410 at 520, the installer can measure the height of the ceiling joists. The installer can then adjust the position of the rails 204*a*, 204*b* (or 104*a*, 104*b*) to correspond to the measured height by moving the rails 204*a*, 204*b* (or 104*a*, 104*b*) along the axis 480.

While the above description provides examples of one or more processes or apparatuses, it will be appreciated that other processes or apparatuses may be within the scope of the accompanying claims.

The invention claimed is:

1. A pot light assembly comprising:

a pot light housing for housing a pot light, the pot light housing having a top portion defining a top end, an opposing bottom portion defining a bottom end and having an opening through which the pot light is receivable, and a side wall extending between the top end and the bottom end;

first and second rail portions secured to the housing for resting on upwardly facing surfaces of first and second ceiling joists, respectively, and supporting the housing between the first and second ceiling joists with the opening of the housing facing downwardly, the first and second rail portions secured to a side wall portion of the side wall at the top portion of the housing at a position that is closer to the top end than the bottom end, the first and second rail portions and the side wall portion extending generally parallel to each other;

first and second fastening brackets secured to the first and second rail portions, respectively, the first and second fastening brackets having first and second fastening plates for securing the first rail portion and the second rail portion to the first and second ceiling joists, respectively, the first and second fastening plates positioned below the first rail portion and the second rail portion;

third and fourth rail portions secured to the housing for resting on upwardly facing surfaces of the first and second ceiling joists, respectively, and supporting the housing between the first and second ceiling joists; and third and fourth fastening brackets for securing the third and fourth rail portions to the first and second ceiling joists, respectively, the third and fourth fastening brackets having third and fourth fastening plates, respectively, the third and fourth fastening plates positioned below the third and fourth rail portions, respectively.

2. The pot light assembly of claim 1, wherein the first rail portion and the second rail portion are separately formed and secured together to form a first rail, the first rail having first and second end portions for resting on the upwardly facing surfaces of the first and second ceiling joists, respectively, and a first central portion between the first and second ends portions, the first central portion secured to the side wall.

3. The pot light assembly of claim 2, wherein the first rail portion and the second rail portion are slidable relative to each other to adjust a length of the first rail.

4. The pot light assembly of claim 1, wherein the first and second fastening brackets have respective fastening holes through which a fastener is receivable to fasten the first and second fastening plates, respectively, to the first and second ceiling joists.

5. The pot light assembly of claim 1, wherein the pot light assembly further comprises a rail track mounted to the side wall portion, and wherein proximal portions of the first and second rail portions are received within the rail track.

6. The pot light assembly of claim 1, wherein the first and second rail portions are movable relative to the housing along a vertical axis extending between the top and bottom ends of the housing.

7. The pot light assembly of claim 6, wherein the pot light assembly further comprises a rail track secured to the side wall portion, the first rail portion and the second rail portion supported in the rail track, and wherein the rail track is moveable relative to the housing along the vertical axis.

8. A kit of parts for a pot light assembly, the kit of parts comprising:

a pot light housing for housing a pot light, the housing having a top portion defining a top end, an opposing bottom portion defining a bottom end and having an opening through which the pot light is receivable, and a side wall extending between the top end and the bottom end;

a rail track secured to the side wall at the top portion of the housing at a position that is closer to the top end than the bottom end;

first and second rail portions receivable in the rail track and securable therein, the first and second rail portions for resting on upwardly facing surfaces of first and second ceiling joists to support the housing between the first and second ceiling joists with the opening of the housing facing downwardly;

first and second fastening brackets for securing the first and second rail portions to the first and second ceiling joists, respectively;

a second rail track secured to the sidewall at the top portion of the housing opposite the first rail track;

third and fourth rail portions receivable in the second rail track and securable therein, the third and fourth rail portions for resting on upwardly facing surfaces of the first and second ceiling joists to support the housing between the first and second ceiling joists; and third and fourth fastening brackets for securing the third and fourth rail portions to the first and second ceiling joists, respectively.

9. The kit of parts of claim 8, wherein the first and second fastening brackets have first and second fastening plates, respectively, and the first and second fastening plates each have a fastening hole for receiving a fastener to secure the first and second rail portions to respective first and second joists.

10. The kit of parts of claim 8, wherein the first and second rail portions are separately formed and are assemblable into a first rail for supporting the pot light housing between the first and second joists.

11. The kit of parts of claim 8, wherein the first and second rail portions are each slidably receivable within the rail track.

* * * * *